US010102778B2

(12) United States Patent
Kakuda et al.

(10) Patent No.: US 10,102,778 B2
(45) Date of Patent: Oct. 16, 2018

(54) INFORMATION WRITABLE FILM AND A SAMPLE STORAGE BODY

(71) Applicants: Shinichiro Kakuda, Hyogo (JP); Yoko Nakahana, Hyogo (JP)

(72) Inventors: Shinichiro Kakuda, Hyogo (JP); Yoko Nakahana, Hyogo (JP)

( * ) Notice: Subject to any disclaimer, the term of this patent is extended or adjusted under 35 U.S.C. 154(b) by 577 days.

(21) Appl. No.: 14/651,871

(22) PCT Filed: Dec. 13, 2013

(86) PCT No.: PCT/JP2013/083516
§ 371 (c)(1),
(2) Date: Jun. 12, 2015

(87) PCT Pub. No.: WO2014/092187
PCT Pub. Date: Jun. 19, 2014

(65) Prior Publication Data

US 2015/0371564 A1 Dec. 24, 2015

(30) Foreign Application Priority Data

Dec. 13, 2012 (JP) ..... 2012-272384

(51) Int. Cl.
*G09F 3/00* (2006.01)
*B41M 5/28* (2006.01)
(Continued)

(52) U.S. Cl.
CPC ..... *G09F 3/0291* (2013.01); *B01L 3/545* (2013.01); *B41M 5/267* (2013.01); *B41M 5/28* (2013.01);
(Continued)

(58) Field of Classification Search
CPC ..... B01L 3/54; B01L 3/545; B01L 2300/02; B01L 2300/021; G09F 3/0291; G09F 3/0295
See application file for complete search history.

(56) References Cited

U.S. PATENT DOCUMENTS 5,773,386 A 6/1998 Langan
5,792,807 A 8/1998 Hayashihara et al.
(Continued)

FOREIGN PATENT DOCUMENTS

JP 11-1596 1/1990
JP 5-289616 11/1993
(Continued)

OTHER PUBLICATIONS

International Search Report, dated Jan. 21, 2014; PCT/JP2013/083516 (submitted Jun. 12, 2015).

*Primary Examiner* — Jill Warden
*Assistant Examiner* — Dwayne K Handy
(74) *Attorney, Agent, or Firm* — Hamre, Schumann, Mueller & Larson, P.C.

(57) ABSTRACT

To provide an information writable film that is chemical and abrasion resistance, and is suitable for high contrast white laser marking. The information writable film comprises a writable film layer 110 and a reading assistance layer 120. The writable film layer 110 is formed into a film shape by thinly stretching a material, which material is a mixture of a color former composition for coloring white when receiving the particular wavelength laser beam by changing its physical and chemical characteristic and a transparent plastic composition. The reading assistance layer 120 is provided enhancing the contrast ratio. The writable film layer 110 is provided with laser coloring properties and chemical and abrasion resistance. During writing, an identification code is written by laser by coloring the color former in the
(Continued)

writable film layer 110. During reading, the contrast ratio is enhanced by superimposing the color of the reading assistance layer 120.

10 Claims, 18 Drawing Sheets

(51) Int. Cl.

| | |
|---|---|
| ***G09F 3/02*** | (2006.01) |
| ***G09F 3/10*** | (2006.01) |
| ***G09F 7/16*** | (2006.01) |
| ***B41M 5/26*** | (2006.01) |
| ***B01L 3/00*** | (2006.01) |
| ***B41M 5/32*** | (2006.01) |
| ***B41M 5/337*** | (2006.01) |
| ***G09F 3/04*** | (2006.01) |

(52) U.S. Cl.

CPC ..... *B41M 5/32* (2013.01); *B41M 5/3377* (2013.01); *G09F 3/02* (2013.01); *G09F 3/0288* (2013.01); *G09F 3/04* (2013.01); *G09F 3/10* (2013.01); *G09F 7/165* (2013.01); *B01L 2300/021* (2013.01); *B41M 2205/04* (2013.01); *B41M 2205/24* (2013.01); *B41M 2205/36* (2013.01); *G09F 2003/0201* (2013.01); *G09F 2003/0211* (2013.01); *G09F 2003/0216* (2013.01); *G09F 2003/0257* (2013.01); *G09F 2003/0273* (2013.01)

(56) References Cited

U.S. PATENT DOCUMENTS

| | | | |
|---|---|---|---|
| 5,981,647 | A | 11/1999 | Okamoto et al. |
| 2004/0132892 | A1 | 7/2004 | Kawakami et al. |
| 2010/0276325 | A1 | 11/2010 | Sakurai et al. |
| 2010/0291354 | A1 | 11/2010 | Kawakami et al. |

FOREIGN PATENT DOCUMENTS

| | | |
|---|---|---|
| JP | 6-48042 | 2/1994 |
| JP | 2000-198903 | 7/2000 |
| JP | 2000-509852 | 8/2000 |
| JP | 2004-176060 | 6/2004 |
| JP | 2006-225569 | 8/2006 |
| JP | 2006-305926 | 11/2006 |
| JP | 2007-313876 | 12/2007 |
| JP | 2010-280790 | 12/2010 |
| JP | 2011-126142 | 6/2011 |
| WO | 2005/059869 | 6/2005 |
| WO | 2006/087965 | 8/2006 |

(a) Cross-sectional view of an information writable film 100
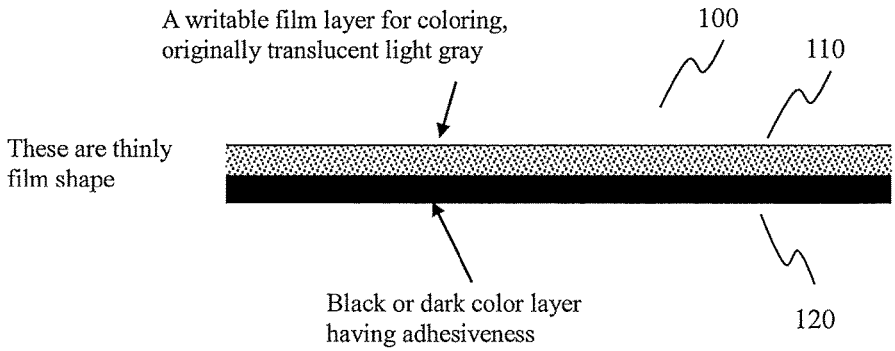
(b) Cross-sectional view of an information writable media 10 in the prior art
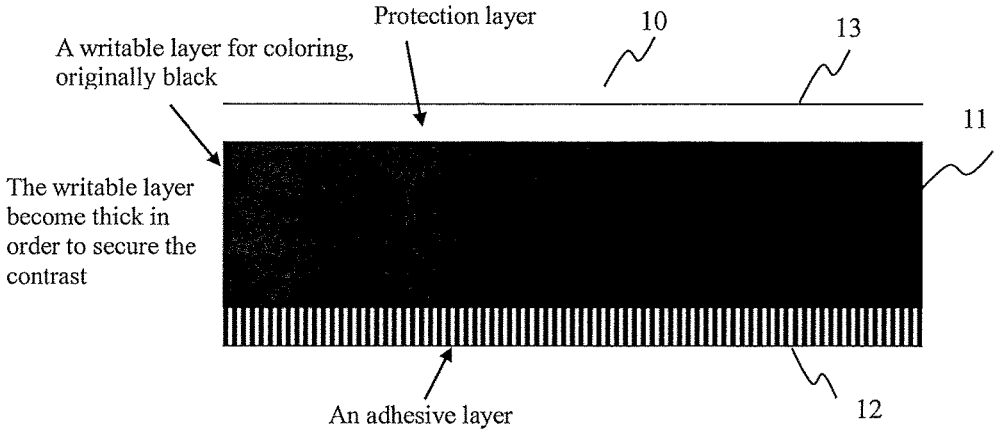
FIG.1

(a) Cross-sectional view showing the laser marking process on the information writable film 100
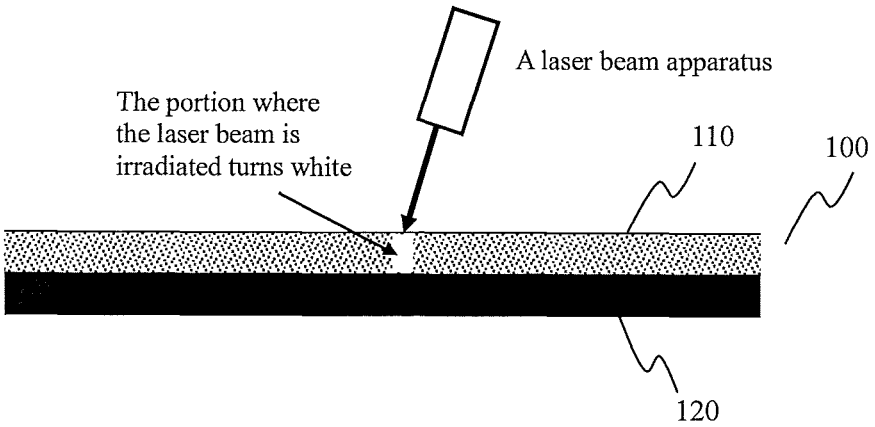
(b) Plain view showing the written pattern on the information writable film 100 by the laser marking
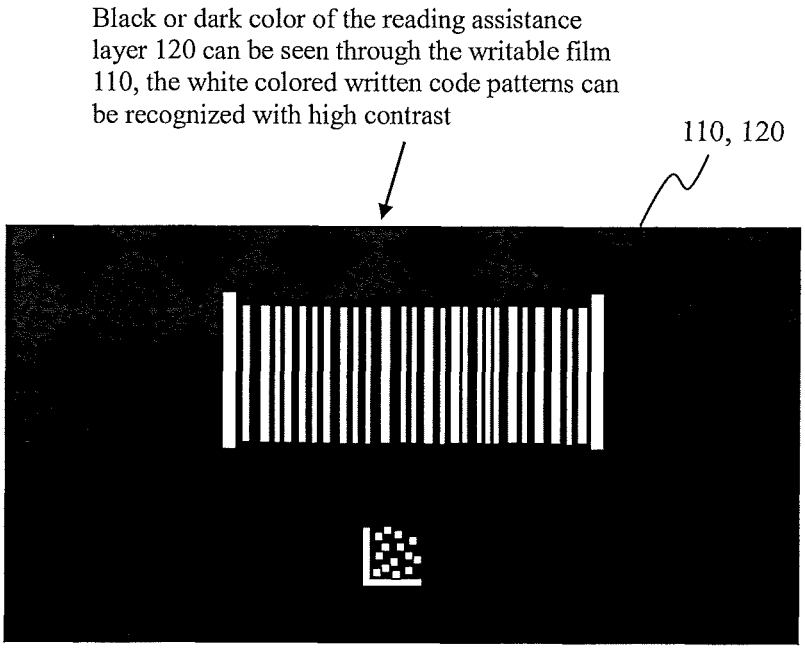
FIG.2

(a) Cross-sectional view showing the laser marking process with only the writable film layer 110
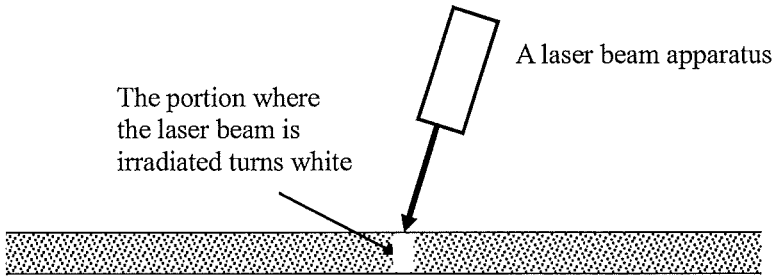
(b) Plain view showing the written pattern on the information writable film 100 with only the writable film layer by the laser marking
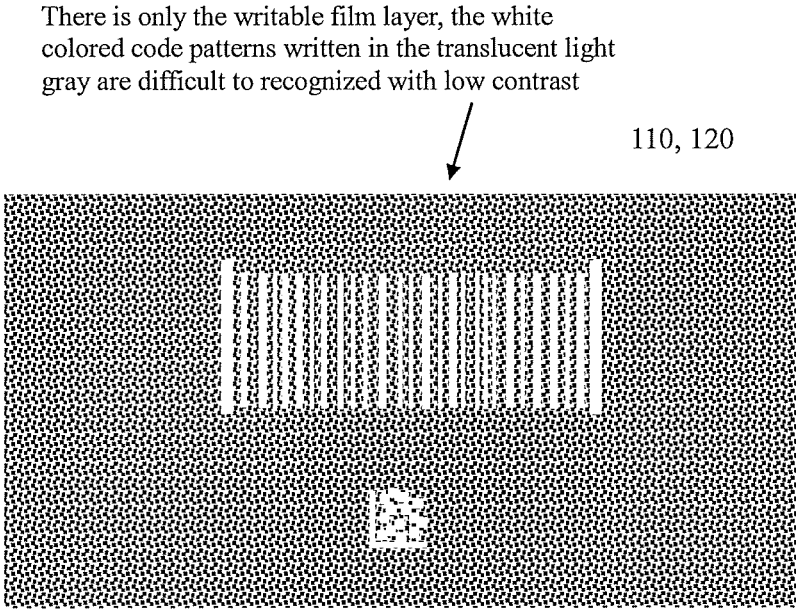
FIG.3

(a) Cross-sectional view of an information writable film 100
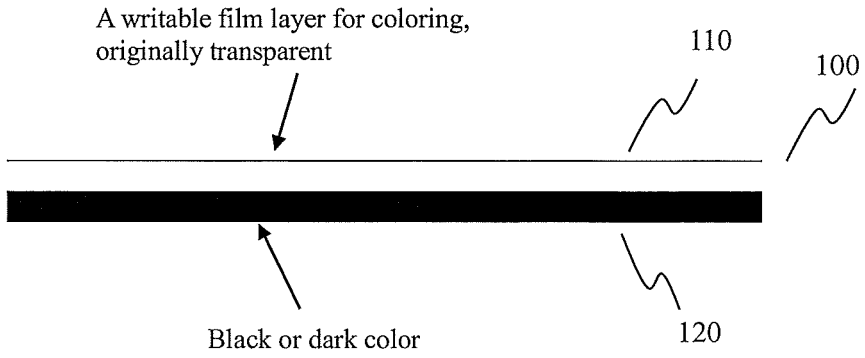
(b) Plain view of the information writable film 100
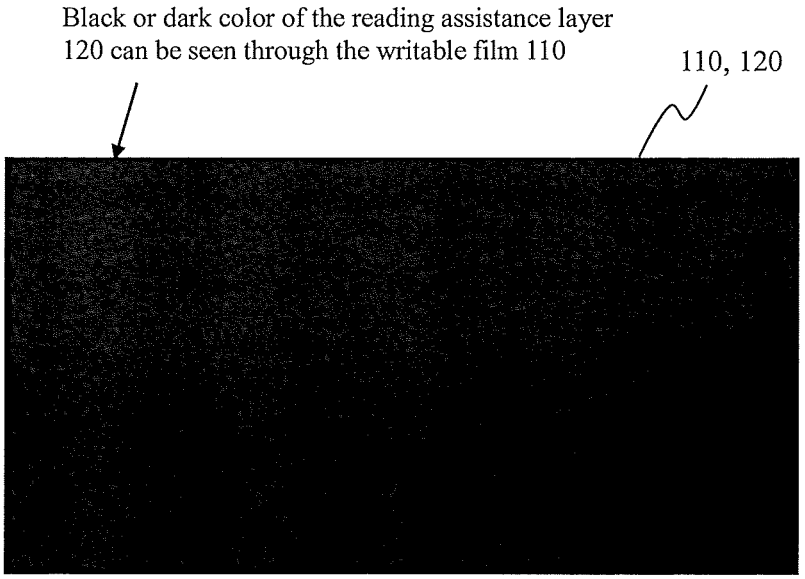
FIG.4

(a) Cross-sectional view showing the laser marking process on the information writable film 100
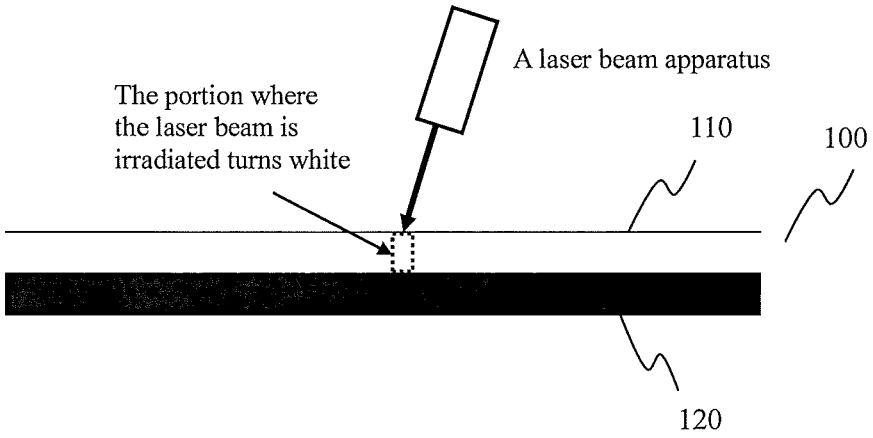
(b) Plain view showing the written pattern on the information writable film 100 by the laser marking
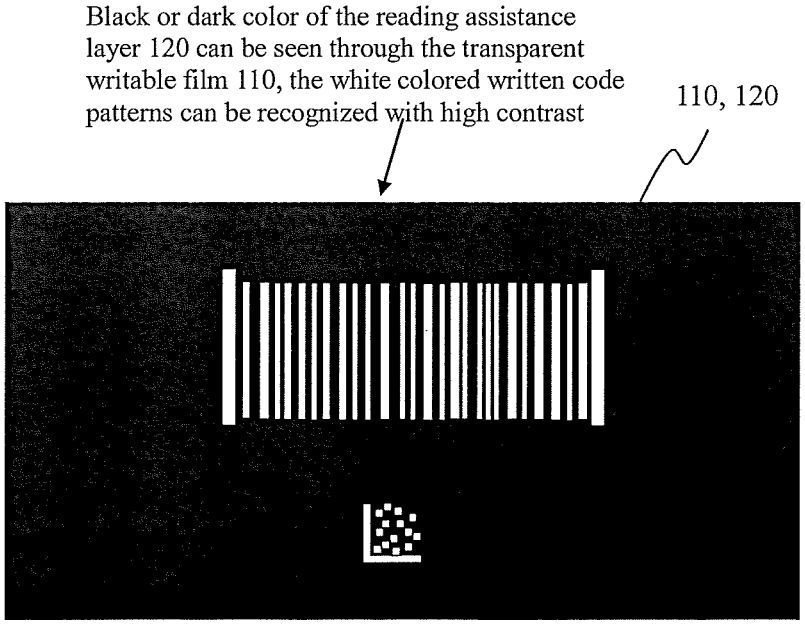
FIG.5

(a) Cross-sectional view of an information writable film 100
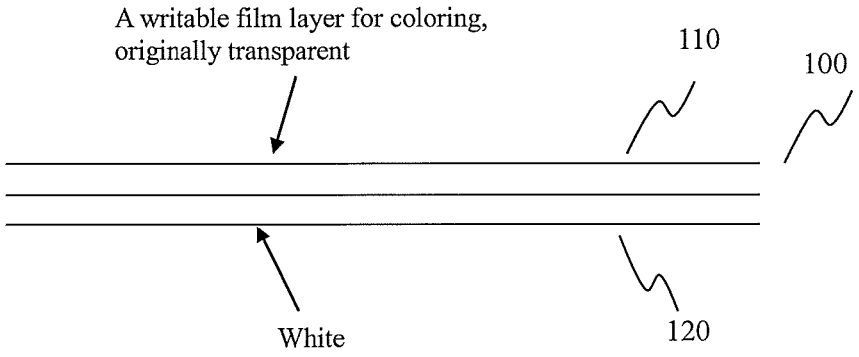
(b) Plain view of the information writable film 100
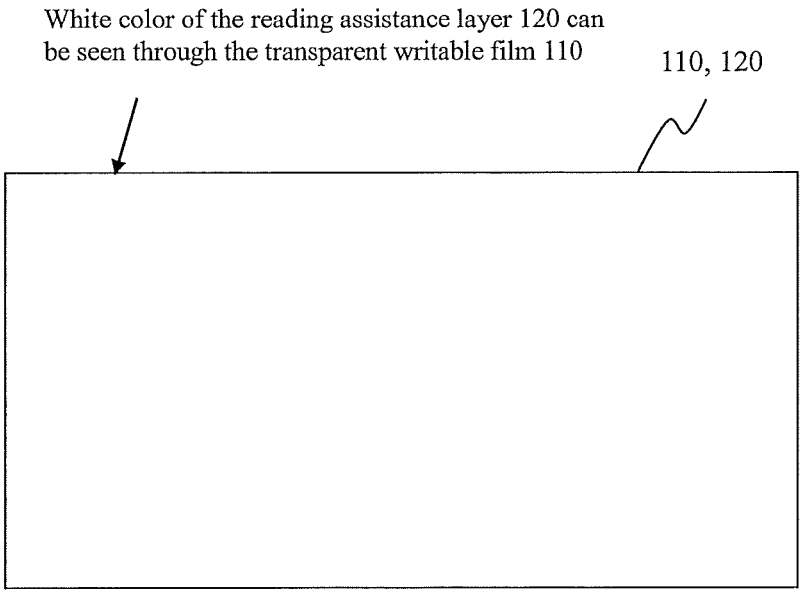
FIG.6

(a) Cross-sectional view showing the laser marking process on the information writable film 100
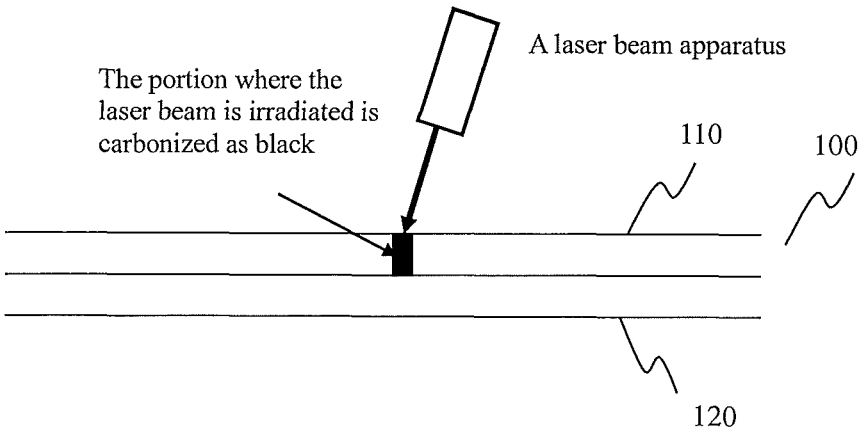
(b) Plain view showing the written pattern on the information writable film 100 by the laser marking
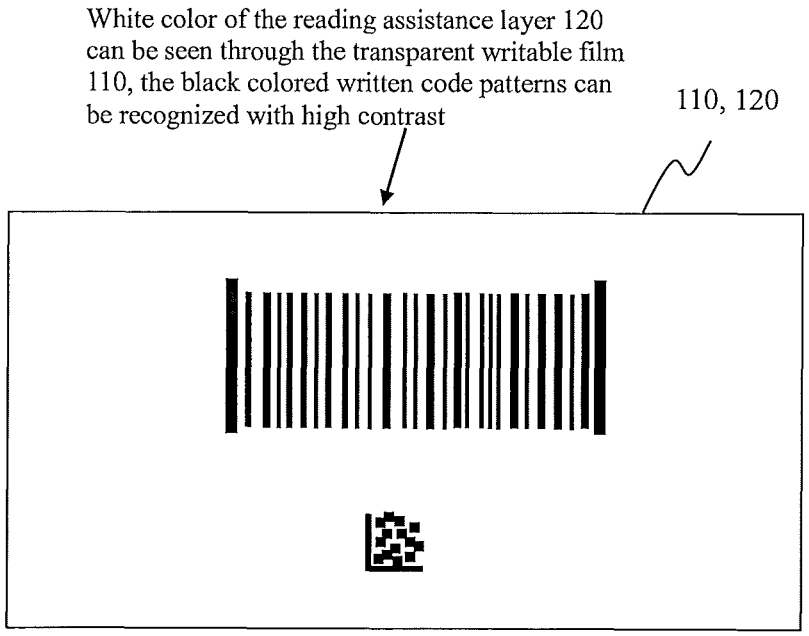
FIG.7

(a) Cross-sectional view showing the laser marking process with only the writable film layer 110
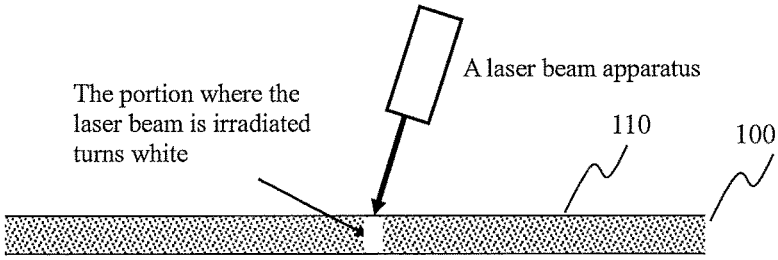
(b) Plain view showing the laser marking process with only the writable film layer 110
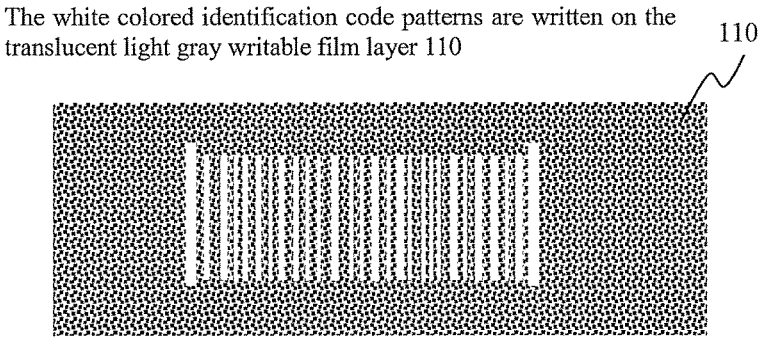
(c) The state of the information writable film 100 adhered on the target object to be written
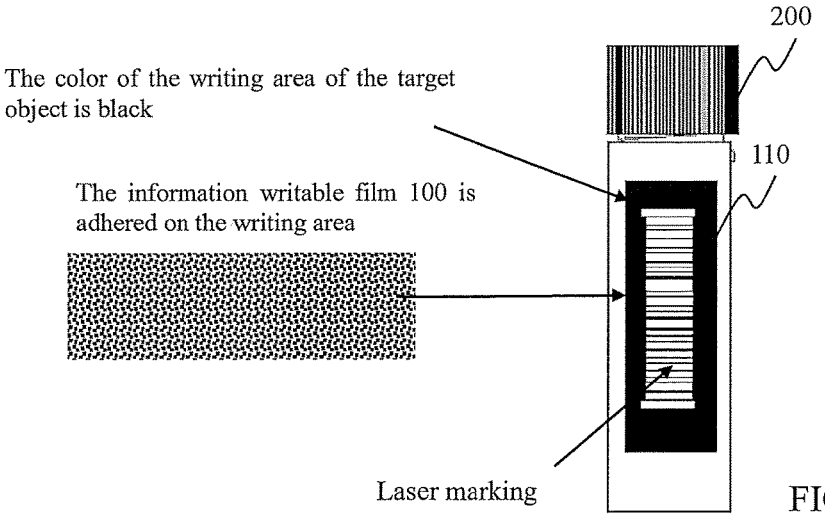
FIG.8

(a) Cross-sectional view showing the laser marking process with only the writable film layer 110
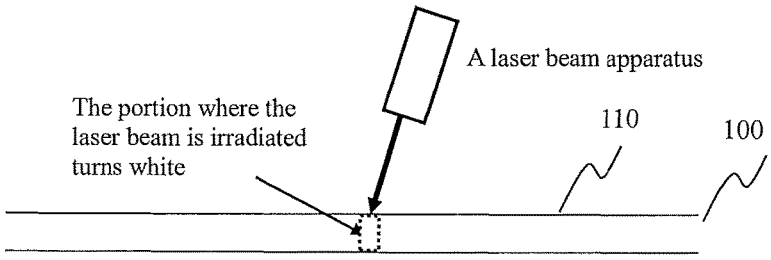
(b) Plain view showing the laser marking process with only the writable film layer 110
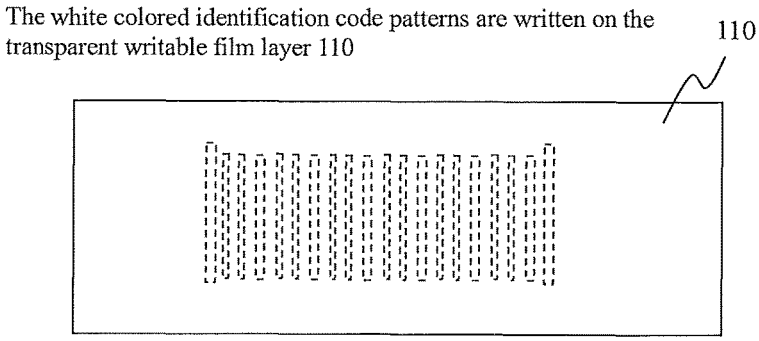
(c) The state of the information writable film 100 adhered on the target object to be written
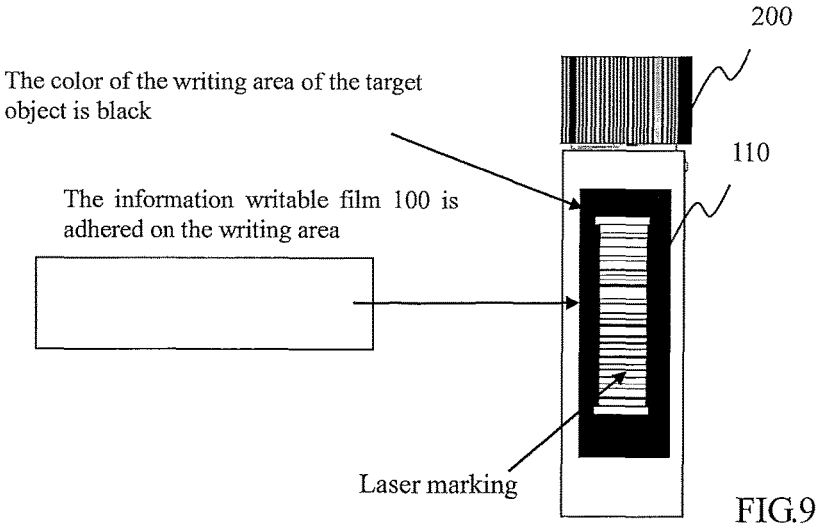
FIG.9

(a) Cross-sectional view of an information writable film 100a1
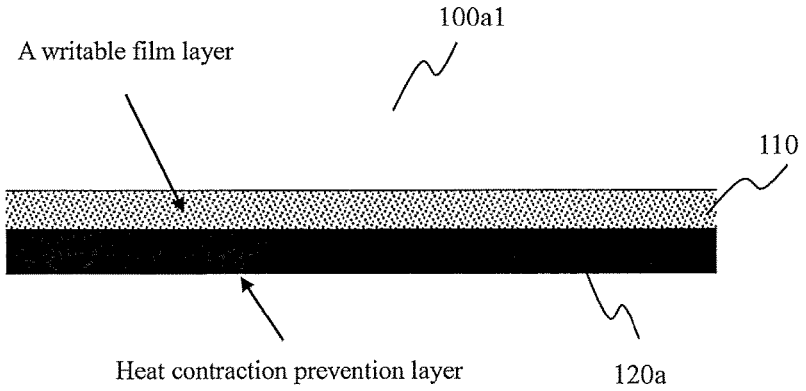
(b) Cross-sectional view of an information writable film 100a2
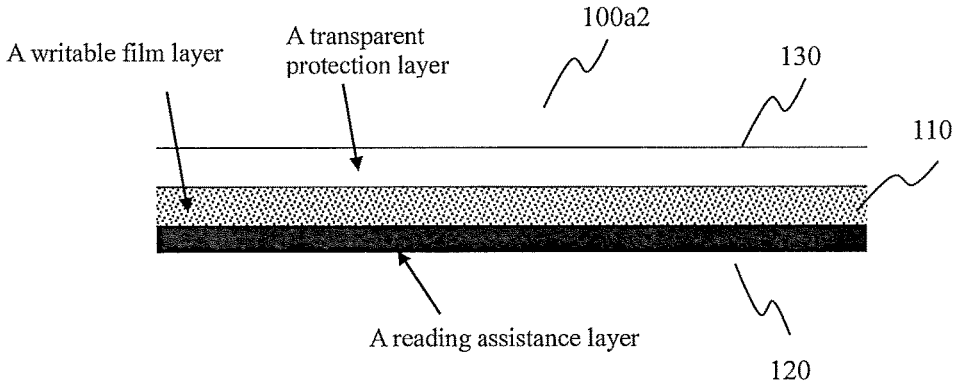
FIG.10

(a) Cross-sectional view showing the laser marking process on the information writable film 100
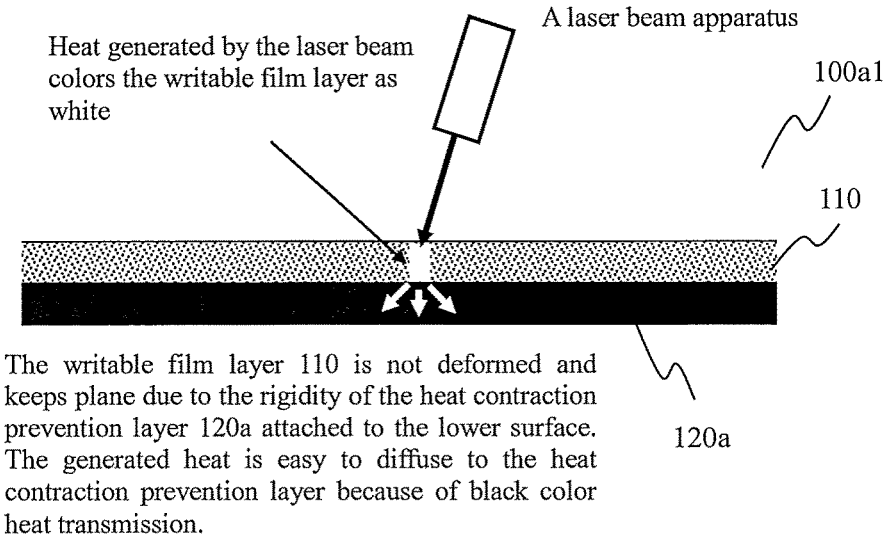
(b) Plain view showing the written pattern on the information writable film 100a1 by the laser marking
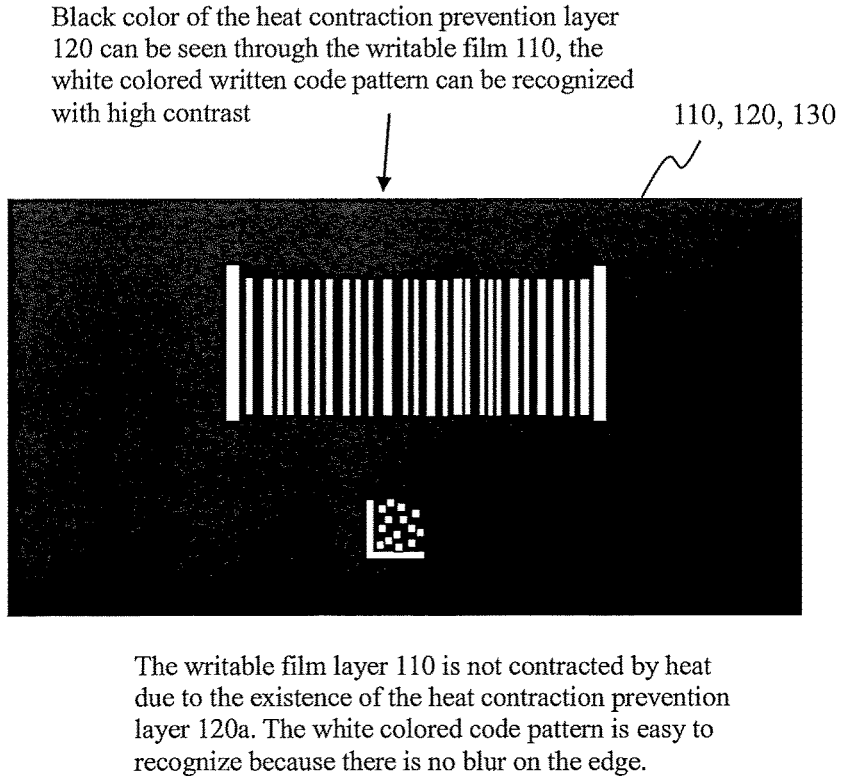
FIG.11

(a) Cross-sectional view showing the laser marking process on the information writable film 100a2

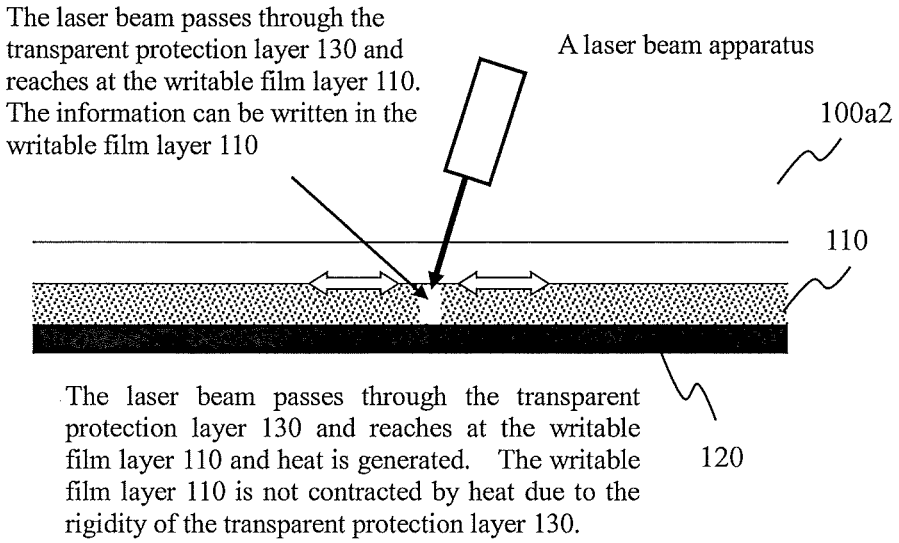

(b) Plain view showing the written pattern on the information writable film 100a2 by the laser marking

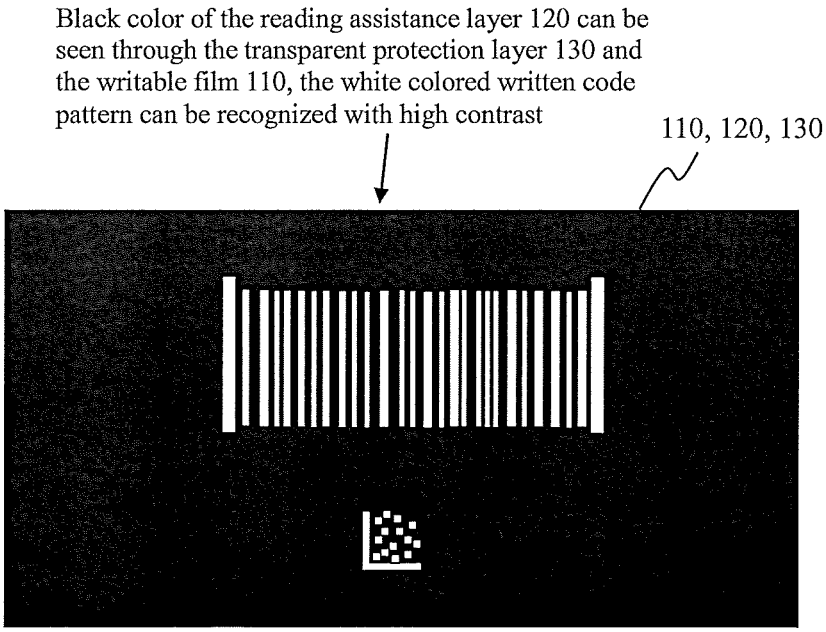

The writable film layer 110 is not contracted by heat due to the existence of the transparent protection layer 130. The white colored code pattern is easy to recognize because there is no blur on the edge.

FIG.12

(a) Cross-sectional view showing the case that heat contraction occurs in the laser marking process on the information writable film 100 without no heat contraction counter measure
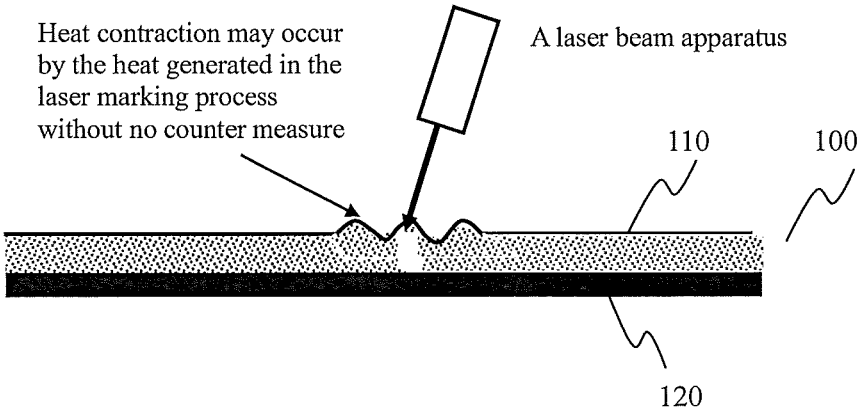
(b) Plane view showing the case that heat contraction occurs in the laser marking process on the information writable film 100 without no heat contraction counter measure
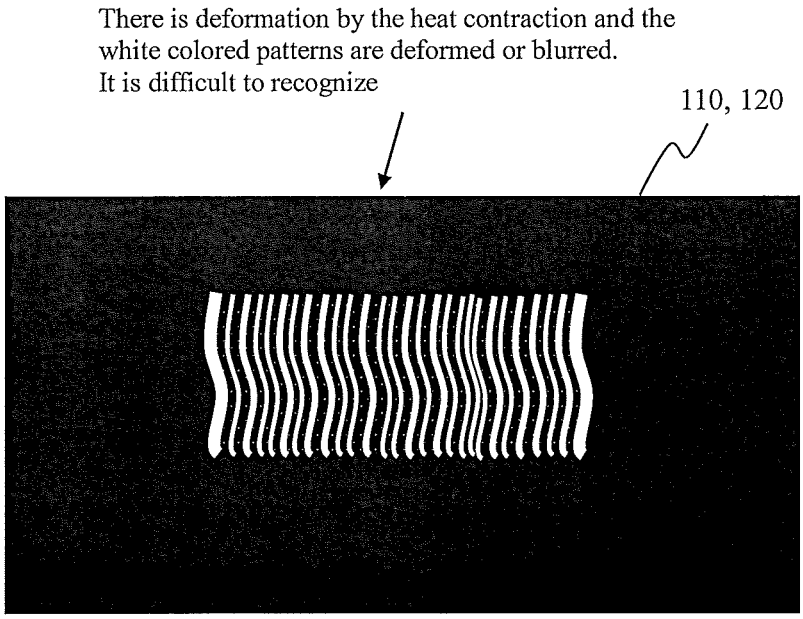
FIG.13

The information writable film 100b is wrapped around by shrink wrap to the container 210.

(a)
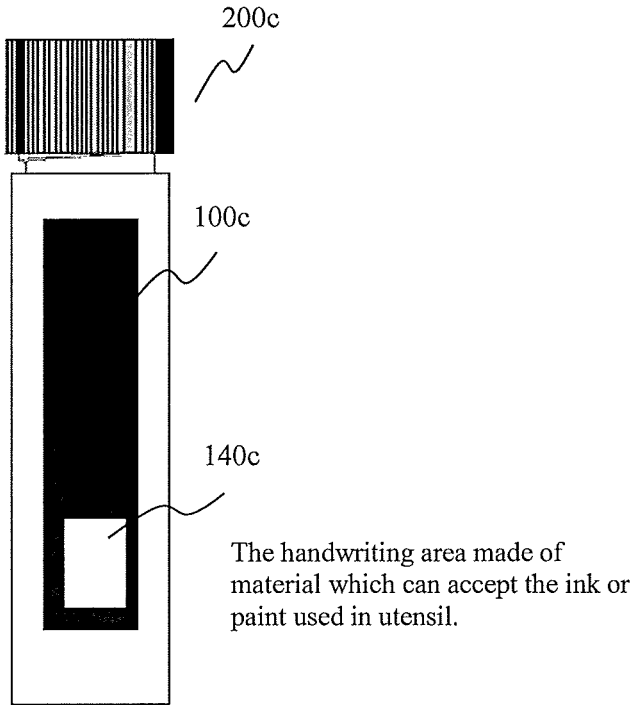
(b)
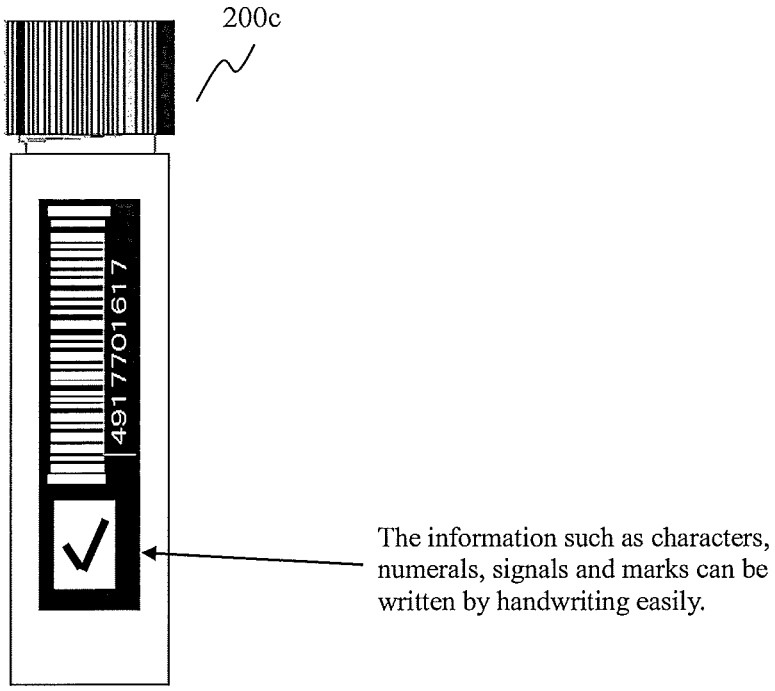
FIG.16

(a)
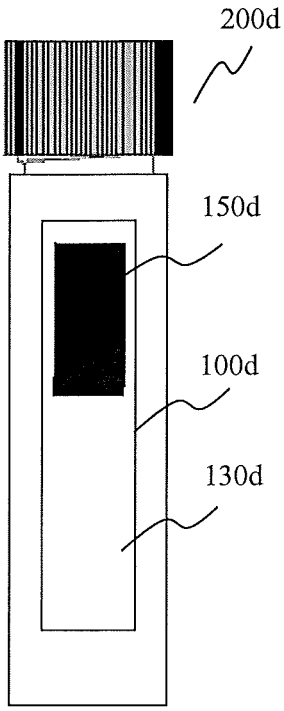
A part of area is provided as the writing area 150, other area is provided as the window through which the inside of the sample storage body 200d can be seen.
(b)
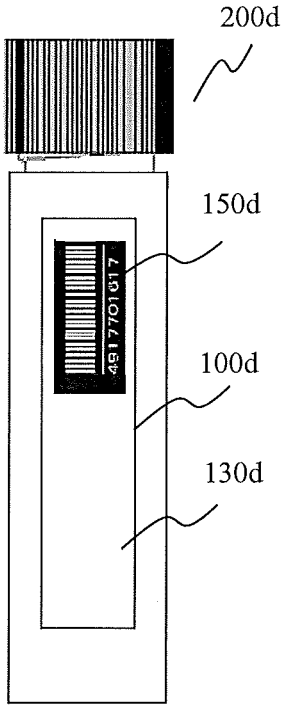
The identification code patterns can be written in writing area 150d and the inside of the sample storage body 200 can be seen through other area.
FIG.17

(a)

The case that the identification code patterns are written by white coloring directly in the black color media

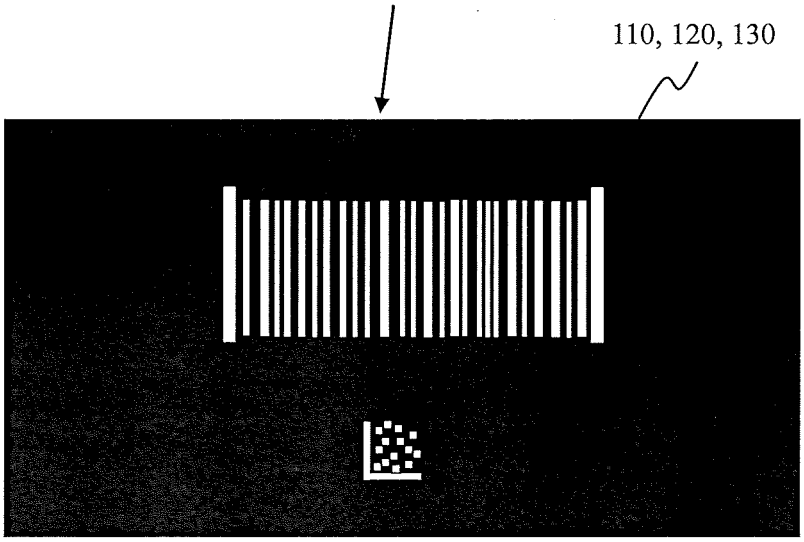

(b) The portions around the barcode patterns and the portions except for the barcode patterns are colored white in order to obtain white base area on the black background, and the portions for the barcode patterns are left black as it is.

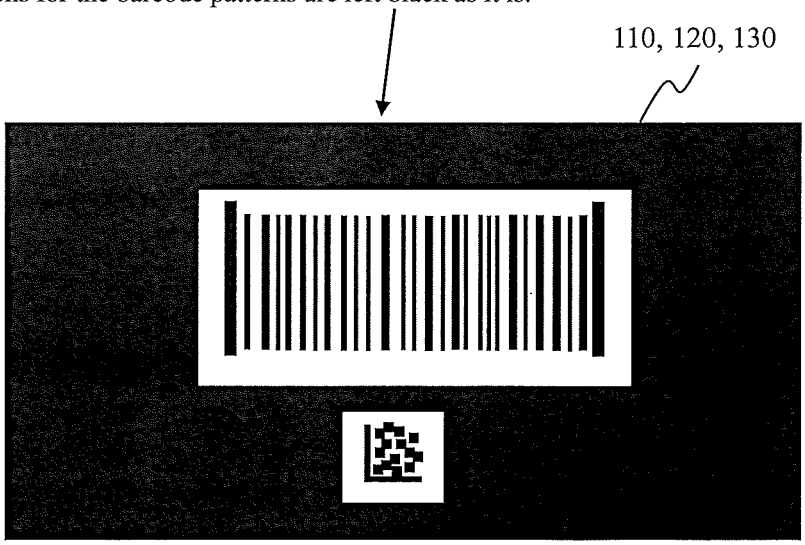

The case that the identification code patterns are expressed by writing the by white coloring directly in the black color media

FIG.18

INFORMATION WRITABLE FILM AND A SAMPLE STORAGE BODY

TECHNICAL FIELD

The present invention relates to an information writable film for laser marking with a sharp laser chromogenic. In particular, it relates to an information writable film for writing information attached to the sample storage body to be used for storing and managing a large number of samples.

Here, the sample storage body may be used in a variety of applications in order to store and manage the sample. For example, it is used in enclosing and storing developing medicine samples. Also, it is used in storing samples that hold gene information of DNA in the medical field.

BACKGROUND ART

In the research and development of medicine and chemicals, storage tubes are extensively used in storing a large number of samples. For example, scientists prepare a large number of samples for a comparative experiment with slightly changing conditions such as blending rate, and they use storage tubes in storing the samples for a required period of time while handling them.

In order to control and store a large number of storage tubes at a time as described above, it is necessary to identify each storage tube. In the prior art, they were identified by handwriting a sample name or identification number directly to the outer surface of storage tubes; however, in recent years sample storages that are controlled by printing a barcode or two-dimensional code on the side and/or bottom surface of the storage tube are highlighted, in which various data and/or control information of a sample are encoded, and then the barcode or two-dimensional code is read in a control process.

Here, the data contents written in the label are a variety of data such as a storing date, a name of the contents, a name of the owner and a serial number written by the identified code such as characters, barcode or two-dimensional code. Regarding the characters, these data can be written by hand-writing, stamp or print. However, barcode or two-dimensional code should be written by printing method.

As mentioned above, it is necessary to print the identification code on the label to identify the individual sample storage body. Especially, the printing technology for the identification code should keep higher contrast ratio even when the printing area is affected by the color of the sample stored in the sample storage body or the surrounding environment in order to read the identification code quickly and accurately.

Recently, the importance of the laser marking technology is increased because it can print the code on label with a non-contact method, high speed and wide applicability. Because of non-contact method, laser marking can print the identification code easily and quickly on the object whose surface has curvature or distortion.

Laser marking is conducted by irradiating the laser beam on the surface of the target object. In this process, the target portion may be overheated locally, and the marking is obtained by physical change of the material or resin on the surface layer, such as to micro-melt, micro-vaporize or micro-burn.

Laser marking method utilizes the change of the physical characteristic or the chemical characteristic of the color former material by absorbing the laser beam energy. Especially, the white laser marking technology which changes black color to white color is useful for printing the identification code because the contrast ratio becomes high.

In the white laser marking technology in the prior art, the white color former is utilized. The white color former is coated on the color forming layer to be changed in color by absorbing the laser beam energy and changing its physical characteristic or its chemical characteristic. The component present in the color former originally exhibits black. The portion that receives laser beam energy is foamed locally. The foams scatter the light, so the foamed portion shows white. For example, a plastic molded object made from thermoplastic resin mixed with additives such as carbon black or titanium sub-oxide originally exhibits black. When it receives laser beam, white color characters, white pattern and white mark can be written on the surface of the plastic molded object (referring to the prior document 1).

Therefore, white color laser marking technology in the prior art requires black color based material for the writable media material. The contrast ratio becomes large if the writable media material exhibits dark color turning to white. Prior art document 1: JP2006-305926.

DISCLOSURE OF THE INVENTION

The Problems to be Solved

In the research and development of pharmaceuticals and chemicals, the sample storage body that can store a large number of samples in the storage tube is spreading. As the material for the sample storage body having high airtightness and high chemical resistance, glass, polypropylene resin, and fluorine resin can be used. It is selected according to the chemical nature of the sample to be stored.

Here, chemical resistance is required for the components of the container wall and the label of a sample storage body.

The white color laser marking technology described in the above background of the prior art is employed in the sample storage body widely. The sample storage body of the present invention is the same. A jacket as an externally equipped body to be applied externally to the glass or plastic sample storage body is made from polypropylene material exhibiting dark black, and the information to be required for storage control can be written on the outer surface of the externally equipped body by irradiating the laser beam. The white color laser marking technology has begun to be used.

The identification code is necessary to identify each sample storage body correctly because each sample is stored in each sample storage body and a large number of the samples storage bodies are contained collectively in the same storage warehouse. Therefore, the material for the writable area where the identification code is to be written should have the chemical resistance and the light transmissive characteristic for observing the inside of the body. For example, the plastic film made from polypropylene can be employed.

Here, if the writable material for the sample storage body is the jacket type component applied externally to the sample storage body, it has enough thickness. Therefore, it is easy to form the jacket type component by employing the dark color material and it is easy to obtain enough high contrast ratio by turning dark color to white and the recognition ratio becomes large. However, the jacket type component applied externally to the sample storage body should be formed to be precisely adjusted to the sample storage body, so it is difficult to apply the jacket type component to various sample storage bodies. It is not appropriate for universal purpose use.

In addition, if there are plural purposes to be satisfied, such as white color forming, improvement of the contrast ratio, improvement of the chemical resistance and adhesive property to the object, the jacket type component should have plural layers, up to four or five. If it is composed of four or five layers, the flexibility decreases. It becomes difficult to follow to the outer wall surface of the sample storage body. In addition, the applied portion may be limited.

The present invention aims at providing thin film type component comprising a single layer or less number of layers having simple structure instead of a large number of layers. In addition, the present invention solves the following problems.

The first purpose to be solved is how to secure the clear white coloring and how to prevent the deterioration of the contrast ratio even it is a thin film type component.

The thin film type component employs the dark color plastic material mixing with the color former including the particular composition in order to absorb the laser beam energy. However, the color becomes lighter and turn to be light gray if it is elongated as a film shape. Therefore, the contrast ratio is not secured even if the identification code is written in white color by the laser marking method and the recognition rate deteriorates in result. If a lot of dark color composition or color former is mixed in the material in order to enhance the contrast ratio simply, other problems may occur such as the problem of preventing the white coloring of the target color former from receiving the laser beam energy by the newly mixed composition and by the change of the composition ratio. In the worst case, white coloring does not appear. There is a delicate composition mixture ratio for the material of the color former including particular composition. A new mixture disturbs the delicate composition mixture ratio.

The second purpose to be solved is how to block the deformation of the surface and the deterioration of the resolution by the thermal contraction in the laser marking process. In the laser marking process, laser beam energy is absorbed by the target composition, whose color changes by change of its physical characteristic or its chemical characteristic. In this process, heat is generated locally, so heat contraction may occur when writing the identification code on the thin film type label. Malfunctions such as deformation, distortion and small wrinkle may occur on the surface. Heat contraction may occur irregularly, and the written identification code may be deformed and the edge of the white and black line be not sharp. This is can be called a "blurred state", and the recognition ratio may deteriorate. The barcode and two-dimensional dot code utilizes the redundancy in order to recognize even if there is partial damage on the code, but such deformation and blurred state may deteriorate the recognition ratio.

The third purpose to be solved is how to secure the chemical resistance and the abrasion resistance. In general, the color former composition that is used as the white color former in the laser marking does have not enough chemical resistance. It may be degenerated by chemicals. In addition, the white colored portion is the foaming portion, so the portion does not have enough abrasion resistance. It is easy to abrade and blur.

In view of these problem and purposes for the laser marking technology in the prior art, the present invention aims at providing the thin film type label which secures the clear white coloring by the laser marking, the high contrast ratio, strength for chemical resistance, strength for abrasion resistance and high adhesiveness to the target object, even if it is made as the thin film label for having flexibility to follow the target object shape.

Means of Solving the Problems

To achieve the above purposes, the first aspect of the information writable film of the present invention applicable to the surface of a target, where the color of the area of the target where the information to be written by a laser marking is originally black and a mark written in the information writable film is white, comprises; a writable film layer made of light-transmissive material formed in a film shape, wherein a color former including a photo-sensitive composition or a heat-sensitive composition that can be changeable from the black color whose light transmission ratio is 0% to 95% to the white color state by shifting its physical characteristic or its chemical characteristic by irradiating a particular wavelength laser beam is present, not as it is but mixed with the transparent plastic resin having enough chemical resistance and structural strength.

The writable film layer as a single layer has enhanced chemical resistance and structural strength by mixing with the transparent plastic resin. The base black color behind the writable film layer prevents the deterioration of the contrast ratio of the writable film layer due to mixing with the transparent plastic resin by presenting its black color as a background color against the writable film layer.

Next, the second aspect of the information writable film of the present invention applicable to the surface of a target, where the color of the area of the target where the information to be written by a laser marking is originally black and a mark written in the information writable film is white, comprises; a writable film layer made of light-transmissive material formed in a film shape, wherein a color former including a photo-sensitive composition or a heat-sensitive composition that can be changeable from the transparent state to the white color state by shifting its physical characteristic or its chemical characteristic by irradiating a particular wavelength laser beam is present, not as it is but mixed with the transparent plastic resin having enough chemical resistance and structural strength. The writable film layer as a single layer has enhanced chemical resistance and structural strength by mixing with the transparent plastic resin. The base black color behind the writable film layer prevents the deterioration of the contrast ratio of the writable film layer due to mixing with the transparent plastic resin by presenting its black color as a background color against the writable film layer.

Next, the third aspect of the information writable film of the present invention applicable to the surface of a target, where the color of the area of the target where the information to be written by a laser marking is not limited and a mark written in the information writable film is white, comprises; a writable film layer made of light-transmissive material formed in a film shape, wherein a color former including a photo-sensitive composition or a heat-sensitive composition that can be changeable from the black color whose light transmission ratio is 0% to 95% to the white color state by shifting its physical characteristic or its chemical characteristic by irradiating a particular wavelength laser beam is present, not as it is but mixed with the transparent plastic resin having enough chemical resistance and structural strength; a reading assistance layer under the writable film layer, whose color is darker black having lower light transmission ratio than that of the writable film layer, and having the adhesiveness to the surface of the target. The writable film layer with the reading assistance layer as a two layers enhances the chemical resistance and the structural strength by mixing with the transparent plastic resin, and prevents the deterioration of the contrast ratio due to mixing with the transparent plastic resin by superimposing the black color of the reading assistance layer.

Next, the fourth aspect of the information writable film of the present invention applicable to the surface of a target, in which the color of the area of the target where the information to be written by a laser marking is not limited and a mark written in the information writable film is white, comprises; a writable film layer made of light-transmissive material formed in a film shape, wherein a color former including a photo-sensitive composition or a heat-sensitive composition that can be changeable from the transparent state to the white color state by shifting its physical characteristic or its chemical characteristic by irradiating a particular wavelength laser beam is present, not as it is but mixed with the transparent plastic resin having enough chemical resistance and structural strength; a reading assistance layer under the writable film layer, whose color is black and having the adhesiveness to the surface of the target. The writable film layer with the reading assistance layer as two layers enhances the chemical resistance and the structural strength by mixing with the transparent plastic resin, and prevents the deterioration of the contrast ratio due to mixing with the transparent plastic resin by superimposing the black color of the reading assistance layer.

According to the above-mentioned configurations, the information writable film provides the thin film type label that can secure the clear white coloring by the laser marking and can secure the high contrast ratio even if it is made as the thin film label for having flexibility to follow the target object shape. Furthermore, it can secure the strength of the chemical resistance and the abrasion resistance due to mixing with the transparent plastic resin. Furthermore, it can secure the high adhesiveness to the target object coming from the adhesiveness of the reading assistance layer.

"Transparent" in the present invention means follows. Almost all observers perceive a product as "transparent" when the thickness of the product is 3 mm and its light transmission ratio is around 85%. Of course it depends on the environmental condition. However, if the light transmission ratio is beyond 95%, the product is recognized as transparent and the objects existing over the product can be seen clearly through the product. Therefore, in this present invention, "black" to "light gray" (or translucent black) has the light transmission ratio from 0% to 95%. "Transparent" has the light transmission ratio is over 85%. By this classification, there is an overlapping range from 85% to 95%. This is due to the ambiguity of the human visual sense and there is no clear threshold between the "transparent" and the "translucent". The overlapping range can be treated as "transparent" and "translucent". Therefore, both numeral ranges are overlapped in the present invention.

There are plural patterns for the color combination of the writable film layer and the reading assistance layer.

For example, the original color of the writable film layer before information writing is transparent, the emerging color of the writable film layer after information writing is white, and the color of the reading assistance layer is black. In the writing process, the color former composition turns to white by the laser beam irradiation and the identification code is written. In the reading process, the black color of the reading assistance layer is superimposed to the identification code as the background color. The contrast ratio is enhanced because the portion where the white color emerges is opaque and this portion can be seen as white as it is, and the portion where the white color does not emerge is transparent and this portion can be seen as black coming from the background black.

In another example, the original color of the writable film layer before information writing is translucent light gray, the emerging color of the writable film layer after information writing is white, and the color of the reading assistance layer is black. In the writing process, the color former composition turns to white by the laser beam irradiation and the identification code is written. In the reading process, the black color of the reading assistance layer is superimposed to the identification code as the background color. The contrast ratio is enhanced because the portion where the white color emerges is opaque and this portion can be seen as white as it is, and the portion where the white color does not emerge is translucent and this portion can be seen as black coming from the background black.

The relationship between black and white can be switched with each other.

For example, the original color of the writable film layer before information writing is transparent, the emerging color of the writable film layer after information writing is black, and the color of the reading assistance layer is white. In the writing process, the color former composition turns to black by the laser beam irradiation and the identification code is written. In the reading process, the white color of the reading assistance layer is superimposed to the identification code as the background color. The contrast ratio is enhanced because the portion where the black color emerges is opaque and this portion can be seen as black as it is, and the portion where the black color does not emerge is transparent and this portion can be seen as white coming from the background white.

Similar to the above example, the original color of the writable film layer before information writing is translucent light gray, the emerging color of the writable film layer after information writing is black, and the color of the reading assistance layer is white. In the writing process, the color former composition turns to black by the laser beam irradiation and the identification code is written. In the reading process, the white color of the reading assistance layer is superimposed to the identification code as the background color. The contrast ratio is enhanced because the portion where the black color emerges is opaque and this portion can be seen as black as it is, and the portion where the black color does not emerge is translucent and this portion can be seen as white coming from the background white.

Furthermore, besides the achromatic color as the black and white, the principle of this invention can be applicable to the chromatic color. In this case, the emerging color of the writable film layer after information writing is a chromatic color, and the color of the reading assistance layer is black, white or the chromatic color which is different from the emerging chromatic color. In the writing process, the color former composition turns to a chromatic color by the laser beam irradiation and the identification code is written. In the reading process, black, white or chromatic color of the reading assistance layer is superimposed to the identification code as the background color. The contrast ratio is enhanced because the portion where the chromatic color emerges is opaque and this portion can be seen as chromatic as it is, and the portion where the chromatic color does not emerge is transparent or translucent and this portion can be seen as black, white or other chromatic color coming from the background color.

According to the above-mentioned configurations, the information writable film provides the thin film type label that can write the identification code in the writable film layer, and can read the identification code clearly because the portion where the color emerges is opaque and this portion can be seen as the emerging color as it is, the portion where the color does not emerge is transparent or translucent and this portion can be seen dark color coming from the reading assistance layer by superimposing. The contrast ratio is enhanced because the edge of color becomes sharp and the recognition ratio becomes large as a result.

If the color of the reading assistance layer does not overlap the identification code, the portion where the color does not emerge is transparent or translucent as it is, and the edge becomes blurred and ambiguous compared with the portion where the color emerges. A sufficient contrast ratio is not obtained. However, the present invention employs the color of the reading assistance layer that overlaps the identification code, and the edge becomes sharp and clear compared with the portion where the color emerges. Especially, the color of the reading assistance layer is selected as the color that makes the edge sharp compared with the emerging color of the writable film layer. The contrast ratio becomes large as a result.

Here, the pattern for the case in which the emerging color of the writable film layer is white includes the case that the white color emerges by foaming the color former composition in the writable film layer by the laser beam irradiation, in addition to the case that the white color emerges by changing the color of the color former composition to white directly in the writable film layer by the laser beam irradiation. The pattern for the case that the emerging color of the writable film layer is black includes the case in which the black color emerges by carbonizing the color former composition in the writable film layer by the laser beam irradiation, in addition to the case in which the black color emerges by changing the color of the color former composition to black directly in the writable film layer by the laser beam irradiation.

Examples of the material of the transparent plastic resin are selected from the group consisting of polypropylene, polyethylene, polyethylene terephthalate, polybutylene terephthalate, polycarbonate, polyamide, polyester, polystyrene, polyolefin type elastomer, polyester type elastomer, polyamide elastomer, polyamide-imide elastomer, polyester elastomer, polysulfone, polyether sulfone, polyphenylene ether, polyphenylene sulfide, liquid crystal polymer, polyvinylidene fluoride, polytetrafluoroethylene, styrene/vinylidene acetate copolymer, polyether ester amide, phenolic resin, epoxy resin, novolak resin, ABS resin and ASA resin.

For example, polypropylene has high chemical resistance, so polypropylene is preferable for the information writable film as a part of the sample storage body.

Furthermore, the examples of the white color former composition that changes its color from transparent to white are lower titanium oxide described as Ti(n)O(2n−1) (n=1, 2, 3) such as titanium monoxide, titanium dioxide, dititanium trioxide and trititanium pentoxide, or lower titanium oxide described as TiO(m) (m=1 to 1.99), or lower titanium oxide called as "black titanium oxide" described as TiO(n) (n=1 to 1.9). These lower titanium oxides can oxidize by laser beam energy to TiO2, whose color is white. These lower titanium oxides can be provided as a white color former composition.

Examples of the white color former composition that changes its color from black to white are selected from the group consisting of carbon black, metal oxide, metal nitride, metal sulfide.

For example, color former composition 0.0005 to 5 weight % and transparent plastic resin 100 weight % are mixed.

Regarding the laser apparatus, it is enough if it can colors the color former composition. For example, a $CO_2$ laser can be employed.

There are various patterns for the reading assistance layer configuration.

First, a film sheet having a black color or dark color impregnated with the adhesive agent can be applied under the writable film layer as the reading assistance layer. It can serve both as the component for enhancing the contrast ratio and as the component for adhesive to the surface of the target.

Second, an adhesive agent having a black color or dark color can be applied under the writable film layer as the reading assistance layer. It can serve both as the agent for enhancing the contrast ratio and as the agent for adhesive to the surface of the target. In the prior art, there is no technology to use an adhesive agent color as a reading assistance purpose. There is no adhesive agent that serves both for reading assistance function and for adhesive function.

Third, an anti-heat contraction black layer having black color or dark color and having a higher rigidity than that of the writable film layer can be applied under the writable film layer as the reading assistance layer. It can serve both as the component for absorbing heat generated in the writing process of the identification code by the laser beam to the writable film layer and as the component for prevention of the heat contraction by its rigidity and as the component for enhancing the contrast ratio by its black or dark color. In the prior art, there is no example for an anti-heat contraction black layer applied under the writable film layer. In addition, it can exhibit a heat absorbing function by its black color and a reading assistance function by its black color. There is no example for an anti-heat contraction black layer serving a heat absorbing function, a deformation preventing function, and a reading assisting function at the same time.

Next, in addition to the above mentioned configuration, a transparent protection layer having higher rigidity than that of the writable film layer and the reading assistance layer can be applicable above the writable film layer. This transparent protection layer can protect the lower components from the surrounding environment, and it can transmit through the laser beam to the writable film layer for writing the identification code directly in information writing process. Furthermore, the transparent protection layer has higher rigidity, so it can act as the protector to prevent the writable film layer from deforming by the heat generated by the laser beam to the writable film layer in the identification code writing process.

Next, the transparent protection layer can be provided as the shrink-wrap sheet. The information writable film is applied around the surface of the target object by the shrink-wrap sheeting process in advance for the information writing process. The area of the target where the information is to be written by laser marking has been provided with the information writable film by the shrink-wrap sheet. In the following information writing process, the identification code information can be written by the laser beam through the shrink-wrapped transparent protection layer.

Next, it is preferable that a handwriting area is provided as a partial area of the transparent protection layer, wherein the handwriting area is made of the material that can accept an ink composition for writing or a paint composition for writing. If there are handwriting areas, user convenience will be enhanced because users can write down some information on this area directly by hand besides the mechanical printing of the identification code on the information writable film.

Next, it is preferable that the writable film layer and the reading assistance layer are formed on a part of area of the whole area and the other area of the whole area can be served as a transparent window area composed only by the transparent protection layer. In other word, the information writable film is transparent as a whole except for the area for information writing. According to this configuration, the transparent window area is transparent even though the information writable films are installed, and the inside of the target object can be observed in a wide area.

The relationship between the identification code and background in the writable film layer can be switched. The identification code can be written by the laser marking for coloring a portion as white except for a portion of an identification code pattern. As a result, the identification code emerges as the black patterns of the remaining portion that does not color white. If the identification code is a barcode, there are two patterns. The one is a portion of bars colored white and a remained portion left as it is. The other is a portion of bars is left as it is and a remained left portions between bars is colored white.

Next, the sample storage body of the present invention can be obtained by adhering the information writable film as described above onto a container for containing a sample.

The sample storage body of the present invention can be provided as both a blank state in which no identification codes are written by laser marking, and a written state in which identification codes have been written by laser marking. Furthermore, the information writable films can be installed to both the bottom portion and the upper lid portion in addition to the sidewall. The flexibility of the readable position of the sample storage body becomes large by installing the identification code onto the bottom portion and the upper lid portion besides the side wall portion.

The information writable film can be applicable to various industrial products such as electrical product, electronics product and automobile product by attaching to a portion of a housing of them.

Effect of the Invention

An information writable film according to the present invention enables to obtain the clear white coloring by the laser marking to the writable film layer and obtain the high contrast ratio by superimposing the background color to the identification code. Furthermore, the information writable film enables the high chemical resistance and high abrasion resistance given by the transparent plastic material to be obtained. Furthermore, the information writable film enables to obtain the adhesiveness given by the reading assistance layer to be obtained.

DETAILED DESCRIPTION OF THE PREFERRED EMBODIMENT

Some embodiments of an information writable film and a sample storage body according to the present invention are described below with reference to the relevant drawing. Needless to add, the claims of the present invention include but are not limited to the application, configuration, or quantity shown in the following embodiments.

Embodiment 1

An information writable film 100 in embodiment 1 according to the present invention is described.

The information writable film of the present invention has a various combination of colors among the color of the writable film layer, the color of the color former before and after the coloring, and the color of the reading assistance layer.

Hereinafter, plural combinations are described. It is not limited to the example described below. Other various combinations can be provided.

The example 1 is an information writable film for white laser marking to adhere onto the object regardless of the color variation of its surface.

The combination of colors of the first embodiment is the combination that the original color of the writable film layer before information writing is translucent light gray, the emerging color of the writable film layer after information writing is white, and the color of the reading assistance layer is black (Example 1).

The combination of colors of the first embodiment is the combination that the original color of the writable film layer before information writing is transparent, the emerging color of the writable film layer after information writing is white, the color of the reading assistance layer is black (Example 2).

The combination of colors of the first embodiment is the combination that the original color of the writable film layer before information writing is translucent light gray, and the emerging color of the writable film layer after information writing is black, the color of the reading assistance layer is white (Example 3).

The combination of colors of the first embodiment is the combination that the original color of the writable film layer before information writing is transparent, the emerging color of the writable film layer after information writing is black, and the color of the reading assistance layer is white (Example 4).

The other pattern is an information writable film for white laser marking to adhere on to the object which surface color is white.

The combination of colors of the second embodiment is the combination that the original color of the writable film layer before information writing is translucent light gray (Example 5), and the original color of the writable film layer before information writing is transparent (Example 6).

In this first embodiment, Example 1 to Example 6 are described below.

Regarding "Transparent" in the present invention, almost all observers perceive a product as "transparent" when the thickness of the product is 3 mm and its light transmission ratio is around 85%. If the light transmission ratio is beyond 95%, the product is recognized as transparent and the objects existing over the product can be seen clearly through the product. Therefore, in the following description, "black" to "light gray" (or translucent black) has the light transmission ratio from 0% to 95%. "Transparent" has the light transmission ratio over 85%. By this classification, there is an overlapping range from 85% to 95%. This is due to the ambiguity of the human visual sense and there is no clear threshold between the "transparent" and the "translucent". The overlapping range can be treated as "transparent" and "translucent". Therefore, both numeric ranges are overlapped in the present invention.

Example 1

The example 1 is an information writable film for white laser marking to adhere onto the object regardless of the color variation of its surface.

The first pattern of the first embodiment is the combination that the original color of the writable film layer before information writing is translucent light gray, the emerging color of the writable film layer after information writing is white, and the color of the reading assistance layer is black.

FIG. 1 (*a*) is a schematic view of the first information writable film 100 in embodiment 1. It is shown in the vertical cross-sectional view.

As shown in FIG. 1 (*a*), the first pattern of the information writable film 100 comprises two layers, a writable film layer 110 and a reading assistance layer 120.

The writable film layer 110 is made of material composed of color former B whose original color is black and coloring color is white, mixed with transparent plastic resin A and formed into film shape. The writable film layer 110 contains color former B, so it is not transparent but colored. However, it shows translucent light gray because color former B is mixed with transparent plastic resin A and is extended into a thin film shape.

Transparent plastic material A can be selected from the group consisting of polypropylene, polyethylene, polyethylene terephthalate, polybutylene terephthalate, polycarbonate, polyamide, polyester, polystyrene, polyolefin type elastomer, polyester type elastomer, polyamide elastomer, polyamide-imide elastomer, polyester elastomer, polysulfone, polyether sulfone, polyphenylene ether, polyphenylene sulfide, liquid crystal polymer, polyvinylidene fluoride, polytetrafluoroethylene, styrene/vinylidene acetate copolymer, polyether ester amide, phenolic resin, epoxy resin, novolak resin, ABS resin and ASA resin. Transparent plastic material A can be selected as one of them or plural of them and blended. Transparent plastic materials A may be polymer alloys consisting of two or more resins.

In this example, transparent plastic material A is polypropylene. Polypropylene is one of the suitable materials for the sample storage body because of its chemical stability, high chemical resistance and high transparency.

Next, color former B is described.

The color former B has photo-sensitivity to the light wavelength of the laser beam or heat-sensitivity. The color former B colors its color by changing its physical characteristic or chemical characteristic when receiving the particular wavelength laser beam.

As the color former B for the writable film layer of the present invention, any color former that satisfies the above condition may be employed. In this example, carbon black, lower titanium oxide and silicon containing compound described in JP 2006-305926 are selected.

The color former B including carbon black, lower titanium oxide and silicon containing compound, can color and turn white clearly only where the laser beam having particular wavelength is irradiated even though its original color is black.

JP 2006-305926 describes the mechanism for coloring as follows. The color former including carbon black, lower titanium oxide and silicon containing compound shows its original base color of the product as black mainly coming from carbon black. When receiving a particular wavelength laser beam, white color emerges by decolorization of carbon black and oxidization reaction of the lower titanium oxide to $TiO_2$ whose color is white. In addition, P 2006-305926 describes silicon containing compound assists the white coloring reaction. There are other materials which can be employed as the color former B having photo-sensitivity or heat-sensitivity that changes its physical characteristic or its chemical characteristic by the particular wavelength laser beam. No matter how the coloring mechanisms are, materials which can be employed as the color former B in this present invention are exist. This invention is certainly and firmly performed. The skilled person in this technical field enables color former B of the present invention. The material currently developed and the material to be developed in the future can be employed as color former B such as the material turning from black to white by photo-sensitivity, the material turning from transparent to white by photo-sensitivity, the material turning from black to white by heat-sensitivity, the material turning from transparent to white by heat-sensitivity.

Regarding carbon black, carbon black can be classified as furnace black, channel black and thermal black by its production process, and as acetylene black, ketjenblack, oil black and gas black by its raw material. These materials can be employed as color former B of the present invention.

Regarding the lower titanium oxides, there are lower titanium oxides described as $Ti(n)O(2n-1)$ (n=1, 2, 3) such as titanium monoxide, titanium dioxide, dititanium trioxide and trititanium pentoxide, or lower titanium oxides described as $TiO(m)$ (m=1 to 1.99). Regarding black titanium oxide, it is described as $TiO(n)$ (n=1 to 1.9).

Regarding the silicon containing compound, organic silicon containing compounds such as dimethylpolysiloxane, tetramethoxysilane, silicon ether, silicon ester, or inorganic silicon containing compounds such as silicon dioxide, navy blue, silicon carbide and silicon nitride can be employed. The mixture compound of plural silicon containing compounds such as dimethylpolysiloxane and silicon dioxide can be employed.

Regarding the amount of the color former B added, it is preferable that 0.0005 to 5 pts·mass, more preferably 0.01 to 3 pts·mass, furthermore preferably 0.05 to 1 pts·mass is added to transparent plastic material A at 100 pts·mass. Enough contrast cannot be obtained if the color former B is less than 0.0005 pts·mass. The contrast is deteriorated by the color former B at more than 5 pts·mass because of energy over-absorption.

The amount of each of carbon black, lower titanium oxide and silicon containing compound in the added amount of the color former B is as follows. It is preferable that the adding amount of carbon black is 0.0001 to 2 pts·mass, more preferably 0.005 to 1 pts·mass, furthermore preferably 0.02 to 0.5 pts·mass added to transparent plastic material A at 100 pts·mass. It is preferable that the adding amount of lower titanium oxide is 0.0001 to 2 pts·mass, more preferably 0.005 to 1 pts·mass, furthermore preferably 0.02 to 0.5 pts·mass added to transparent plastic material A at 100 pts·mass. It is preferable that the adding amount of silicon containing compound is 0.0001 to 5 pts·mass, more preferably 0.005 to 5 pts·mass, furthermore preferably 0.02 to 4 pts·mass added to transparent plastic material A at 100 pts·mass.

Other colorant such as inorganic pigment, organic pigment and dye can be added. White coloring can be adjusted by the additional colorant.

Depending on the color adjustment, releasing agent, stabilizer, antioxidant, ultraviolet light absorbent and enriching agent can be added.

The writable film layer 110 is obtained by mixing the above mentioned plastic material A and color former B by mixer and extending thinly into film shape. The thickness of the writable film layer 110 may be a few micrometers.

The color of the writable film layer 110 becomes lighter because it is extended thinly into the film shape. The color of the original mixed transparent plastic material A and color former B becomes lighter to translucent light gray when it becomes thinner. The darker black color turns to lighter black color when it is extended into a film shape. If other colorants are added to the material in order to keep darker black color, the added other colorants may deteriorate other characteristics of the writable film layer such as light-sensitivity to the particular laser wavelength or the white coloring clearness.

Next, the reading assistance layer 120 is described as follows.

The reading assistance layer 120 is installed under the writable film layer 110 and its color is black. The black color of the reading assistance layer 120 is superimposed as the background color. The contrast ratio against the identification code becomes large.

The reading assistance layer 120 can be provided as a film sheet having black color or dark color impregnated with the adhesive agent, or as an adhesive itself having black color or dark color.

If reading assistance layer 120 can be provided as a film sheet, any black film sheet having the chemical resistance may be employed. The information writable film 100 of the present invention will be adhered to the sample storage body, so the chemical resistance is required. For example, polyethylene material with black colorant can be employed. The thickness of the black film sheet of a few micrometers can be applicable as long as it shows black color. Therefore, it is preferable that the black colorant is compounded for displaying black even if the thickness of the film is thin. By the impregnation or coating of the black colorant to the black film, the contrast ratio and the adhesiveness to the target object can be enhanced.

If reading assistance layer 120 can be provided as an adhesive itself, the same as above, it can serve for enhancing the contrast ratio and enhancing the adhesiveness to the target object 200.

The kind of adhesive is not limited, but it is preferable that it has chemical resistance and chemical stability. If the original color of the adhesive is not black, black colorant may be compounded so as to display black color when it is applied to the writable film layer.

The reading assistance layer having the heat contraction prevention function is described in Example 2.

By employing the above mentioned reading assistance layer 120 as shown in FIG. 1 (*a*), the whole information writable film can be seen as darker black coming from the darker black of the reading assistance layer 120 observed through the upper layer of the writable film layer 110 which has translucent light gray.

Here, the writable media 10 for the laser marking in the prior art is explained comparatively with the information writable film 100 of the present invention.

FIG. 1 (*b*) shows the cross-sectional structure of the writable media 10 for the laser marking in the prior art. As shown in FIG. 1 (*b*), the writable media 10 for the laser marking in the prior art is a thick black body media 11 in order to secure the contrast ratio. In addition, transparent protection layer 13 may be added for abrasion resistance and the chemical resistance. In addition, adhesive layer 12 may be added for adhering to the target object. The writable media 10 for the laser marking in the prior art is not provided as film shape but provided as a thicker object or a surface itself of the target object. Therefore, it is lack of universal versatility applicable to the various target objects.

In contrast, as shown in FIG. 1 (*a*), the information writable film 100 of the present invention is provided as a thin film shape, and it can adhere to various target objects because the back of the information writable film 100 has adhesiveness. This invention thus uses a reverse way of thinking, and the information writable film 100 is not formed thicker, but instead to form thin film shapes in order to enhance universal versatility and flexibility for adhering. The demerit of the thinly film form has been solved by the addition of the reading assistance layer.

Next, the writing process of the information writable film 100 of the present invention is described as follows.

As shown in FIG. 2 (*a*), the writable film layer 110 colors white where the particular wavelength laser beam is irradiated.

The laser marking on the information writable film 100 is carried out by exhibiting the photo-sensitivity or the heat-sensitivity of the color former in the writable film layer 110. For example, for the laser beam irradiation apparatus, whose beam diameter is less than 40 micrometer, the laser medium using yttrium-vanadium tetraoxide (YVO4) is employed for the laser marking.

The laser beam used in the laser marking of the present invention may be a single mode laser beam or multimode laser beam. The beam diameter may be narrowed to 20 to 40 micrometer, or may be enlarged to 80 to 100 micrometer.

FIG. 2 (*b*) is a schematic view of the writing result of the laser marking to the information writable film 100. As shown in FIG. 2 (*b*), the pattern of the identification code is written in the writable film layer 110 as the result of the laser marking. The contrast ratio of the white colored identification code becomes larger because of the superimposing of the black color coming from the lower layer of the reading assistance layer 120 through the upper layer of the writable film layer 110.

In contrast, the writing result of the comparison case if the writable film layer 110 without the reading assistance layer 120 is shown as follows.

FIG. 3 (*a*) is a cross sectional view of the laser marking in single writable film layer. As shown in FIG. 3 (*a*), the color former contained in the writable film layer 110 colors white when the particular wavelength laser beam is irradiated. However, as shown in FIG. 3 (*b*), the patterns of the identification code are written in the writable film layer 110 as a result of the laser marking. However, the base writable film layer 110 is translucent light gray and the white colored identification is seen as it is without any assistance. It is difficult to recognize the white colored identification code because of the smaller contrast of the white colored identification code and the background color.

Comparing with the case shown in FIG. 2 (*b*) and FIG. 3 (*b*), the recognition is improved in the present invention because of the enhancement of the contrast ratio between white colored identification code and the background color.

Example 2

The example 2 is an information writable film for white laser marking to adhere onto the object regardless of the color variation of its surface. The second pattern of the first embodiment is the combination that the original color of the writable film layer before information writing is transparent, the emerging color of the writable film layer after information writing is white, and the color of the reading assistance layer is black. The configuration of the information writable film 100 is shown in FIG. 4, which is the same as that of FIG. 1. As shown in FIG. 4 (*a*), it comprises the writable film layer 110 and the reading assistance layer 120.

The writable film layer 110 is made of material composed of color former B which original color is transparent and coloring color is white mixing with transparent plastic resin A and is formed into film shape. Both the color former B and the plastic material A are transparent, so it is a transparent film.

The transparent plastic material A may be the same material described for the first pattern.

The color former B is described as follows.

The color former B is a transparent material whose light transmission ratio is more than 85%. It may be recognized as transparent by human being. The color former B has the photo-sensitivity and the heat-sensitivity for the particular laser beam wavelength. Therefore, the writable film layer has the photo-sensitivity and the heat-sensitivity and turns white by changing the physical characteristic and the chemical characteristic when receiving the particular wavelength.

Any color former in the prior art that satisfies the above-mentioned condition can be employed as the color former B of the writable film layer 110. Here, the material of the color former is composed mainly of lower titanium oxide, which corresponds to the color former described in the example 1 except for the carbon black.

With the color former B including lower titanium oxide compound, the portion where the particular wavelength laser beam irradiated colors white due to the laser marking even though the original color is transparent. For example, such color former is described in JP2010-280790.

The color former including lower titanium oxide through the visible ray but absorbs the energy of the particular wavelength beam irradiated from the laser apparatus such as CO2 laser apparatus. When the receiving the irradiation of the laser beam, lower titanium oxides can oxidize by laser beam energy to $TiO_2$ whose color is white. Furthermore, the silicon containing compound assists the white coloring reaction.

The material currently developed and the material to be developed in the future can be employed as color former such as the material turning from transparent to white by photo-sensitivity, the material turning from transparent to white by heat-sensitivity.

Regarding the lower titanium oxides, lower titanium oxides described as Ti(n)O(2n−1) (n=1, 2, 3) such as titanium monoxide, titanium dioxide, dititanium trioxide and trititanium pentoxide, or lower titanium oxides described as TiO(m) (m=1 to 1.99) can be employed. Regarding black titanium oxide, it is described as TiO(n) (n=1 to 1.9).

Regarding the silicon containing compound, organic silicon containing compounds such as dimethylpolysiloxane, tetramethoxysilane, silicon ether, silicon ester, or inorganic silicon containing compounds such as silicon dioxide, navy blue, silicon carbide and silicon nitride can be employed. The mixture compound of plural silicon containing compounds such as dimethylpolysiloxane and silicon dioxide can be employed.

Regarding the adding amount of the color former B, it is preferable that 0.0005 to 5 pts·mass, more preferably 0.01 to 3 pts·mass, furthermore preferably 0.05 to 1 pts·mass is added to transparent plastic material A at 100 pts·mass. Enough contrast cannot be obtained with the color former B at less than 0.0005 pts·mass. The contrast is deteriorated by the color former B at more than 5 pts·mass because of energy over-absorption.

Other colorant such as inorganic pigment, organic pigment and dye can be added. White coloring can be adjusted with the additional colorant.

Depending on the color adjustment, releasing agent, stabilizer, antioxidant, ultraviolet light absorbent and enriching agent can be added.

The writable film layer 110 is obtained by mixing the above mentioned plastic material A and color former B in a mixer and extending thinly into the film shape. The thickness of the writable film layer 110 may be a few micrometers.

As described above, the writable film layer 110 is obtained. The writable film layer 110 changes its color to white by absorbing the energy of the particular wavelength of the laser beam.

The color of the reading assistance layer 120 is black in this example. The reading assistance layer 120 is the same configuration as shown in the example 1.

The writing processing for the information writable film 100 in this example 2 is the same process as shown in FIG. 2 of the example 1.

As shown in FIG. 5 (*a*), the writable film layer 110 changes its color to white by the laser beam irradiation.

FIG. 5 (*b*) is the schematic view of the laser marking process of the information writable film 100 in this example 2. As shown in FIG. 5 (*b*), the identification code patterns are written in white in the writable film layer 110 by the laser marking, the black color of the reading assistance layer 120 is superimposed as the background color through the upper writable film layer 110. In result, the white identification code patterns can be recognized easily due to the high contrast ratio.

Example 3

Next, example 3 are described as follows.

The configuration of the example 1 is the coloring color of the writable film layer 110 is white, the color of the reading assistance layer 120 is black. However, this example 3 is the reverse example in that the original color of the writable film layer 110 is translucent light gray, the coloring color of the writable film layer 110 is black, and the color of the reading assistance layer 120 is white.

FIG. 6 is the schematic view of the configuration of the information writable film 100 of this example 3. It is shown as the original color of the writable film layer is translucent light gray, the coloring color of the writable film layer is black, and the color of the reading assistance layer is white.

As shown in FIG. 6 (*a*), it comprises the writable film layer 110 and the reading assistance layer 120. The writable film layer 110 is translucent light gray but it changes its color as black when receiving the energy of the particular wavelength irradiation.

The detailed description is omitted here because the information writable film of this example 3 is the same as shown in example 1 except for the coloring mechanism for the color former based on the carbonization by the heat generated by laser beam.

Example 4

Next, example 4 is described as follows.

The configuration of the example 2 is the coloring color of the writable film layer 110 is white, the color of the reading assistance layer 120 is black. However, this example 4 is the reverse example in that the original color of the writable film layer 110 is transparent, the coloring color of the writable film layer 110 is black, and the color of the reading assistance layer 120 is white.

FIG. 7 is the schematic view of the laser marking writing process of the information writable film 100 of this example 4. As shown in FIG. 7 (*a*), the information writable film 100 of this example is irradiated by the laser beam, and the portion receiving the laser beam colors black. As a result, as shown in FIG. 7 (*b*), the identification code pattern are written in black in the writable film layer 110 by the laser marking, and the white color of the reading assistance layer 120 is superimposed as the background color through the upper writable film layer 110. As a result, the white identification code patterns can be recognized easily by its high contrast ratio.

The detailed description is omitted here because the information writable film of this example 4 is the same as shown in example 2 except for the coloring mechanism for the color former based on the carbonization by the heat generated by laser beam.

Example 5

Next, example 5 is described as follow.

The configuration of the example 5 is that of the information writable film for coloring white pattern, the writable area on the target surface whose color is black, and the color of the writable film layer 100 being translucent light gray.

The configuration of example 5 is a single layer comprising only the writable film layer 110 without reading assistance layer 120 described in example 1.

The writable film layer 110 is the same as shown in example 1, and the detailed explanation is omitted here.

FIG. 8 is the schematic view of the laser marking writing process of the information writable film 100 comprising only the writable film layer 110 and how the identification code patterns are recognized.

As shown in FIG. 8 (*a*), when the particular wavelength laser beam is irradiated to the translucent light gray writable film layer 110, the patterns are written in white as shown in FIG. 8 (*b*) by the same principle as described by FIG. 2 (*a*). Without the superimposing of the basic color of the writable area, the patterns edges may be not clear because of the contrast between white and translucent light gray.

However, as shown in FIG. 8 (*c*), if the original surface color of the written area of the target object is black and the information writable film are adhered onto there, the patterns are recognized clearly by the high contrast ratio between white patterns and black background.

As shown above, if the surface color of the written area of the target object is black, the information writable film can be provided as the single layer of the writable film layer 110 without the reading assistance layer 120. To secure the written area of the target object as black, the target object may be made as black originally or the writable area of the target object may be coated as black.

Example 6

Next, example 6 is described as follow.

The configuration of the example 6 is that of the information writable film for coloring white pattern, the writable area on the target surface which color is black, and the color of the writable film layer 100 is transparent.

The configuration of example 6 is a single layer comprising only the writable film layer 110 without reading assistance layer 120 described in example 2.

The writable film layer 110 is the same as shown in example 2, and the detailed explanation is omitted here.

FIG. 9 is the schematic view of the laser marking writing process of the information writable film 100 comprising only the writable film layer 110 and how the identification code patterns are recognized.

As shown in FIG. 9 (*a*), when the particular wavelength laser beam is irradiated to the transparent writable film layer 110, the patterns are written in white as shown in FIG. 9 (*b*) by the same principle as described by FIG. 5 (*a*). Without the superimposing of the basic color of the writable area, the patterns edges may be not clear because of the contrast between white and transparent.

However, as shown in FIG. 9 (*c*), if the original surface color of the written area of the target object is black and the information writable film is adhered onto it, the patterns are recognized clearly by the high contrast ratio between white patterns and black background.

As shown above, if the surface color of the written area of the target object is black, the information writable film can be provided as the single layer of the writable film layer 110 without the reading assistance layer 120. To secure the written area of the target object as black, the target object may be made as black originally or the writable area of the target object may be coated as black.

The information writable film 100 of the first embodiment is described above, and other combinations are possible in the original color of the writable film layer before coloring, the coloring color of the writable film layer after coloring and the color of the reading assistance layer.

Regarding the original color of the writable film layer before coloring, transparent, achromatic (black, gray, white, etc.) and chromatic (red, yellow, green, orange, pink, etc.) can be used for example. Regarding the coloring color of the writable film layer after coloring, achromatic different from the original color (black, gray, white, etc.), and chromatic different from the original color (red, yellow, green, orange, pink, etc.) can be used for example. Regarding the color of the reading assistance layer, achromatic (black, dark gray, light gray, white), and chromatic different from the color of the writable film layer (red, yellow, green, orange, pink, etc.) for example.

Embodiment 2

The information writable film of the embodiment 2 is described as follows.

The information writable film of the embodiment 2 comprises the writable film layer 110, the reading assistance layer 120 and the element for preventing the heat contraction by the heat generated by the laser irradiation in the writing process.

There are two structures. The one is adding the heat contraction prevention layer to the lower surface of the writable film layer 110, and the other is adding the heat contraction prevention layer to the upper surface of the writable film layer 110.

FIG. 10 is a schematic view of the structure of the information writable film 100*a*1 and 100*a*2 of this embodiment 2. It is shown in cross-sectional view.

FIG. 10 (*a*) shows the example of the information writable film 100*a*1 of this embodiment 2. It shows the example adding the heat contraction prevention layer 120*a* to the lower surface of the writable film layer 110. FIG. 10 (*b*) shows the example of the information writable film 100*a*2 of this embodiment 2. It shows the example adding the transparent protection layer for preventing heat contraction to the upper surface of the writable film layer 110.

First, the example shown in FIG. 10 (*a*) is described as follows.

The information writable film 100*a*1 of this embodiment 2 shown in FIG. 10 (*a*) comprises the writable film layer 110 and the heat contraction prevention layer 120*a* under the writable film layer 110.

The writable film layer 110 may be the same as embodiment 1, and the description is omitted here. Various combinations are possible as described in embodiment 1.

In this example, the original color of the writable film layer 110 before coloring is translucent light gray, the coloring color of the writable film layer 110 after coloring is white and the color of the heat contraction prevention layer 120*a* is black, for example.

The heat contraction prevention layer 120*a* is in black color and has larger rigidity than that of the writable film layer 110. The heat contraction prevention layer 120*a* serves the prevention function for preventing the heat contraction by its rigidity larger than that of the writable film layer 110.

FIG. 11 is a schematic view of the laser marking writing process of the information writable film 100*a* employing this heat contraction prevention layer 120*a*. The same as embodiment 1, the information writable film 100 of this example is irradiated by the laser beam, and the portion receiving the laser beam colors white. In result, the identification code patterns are written in white in the writable film layer 110 by the laser marking.

Here heat is generated in the laser marking process. If there is no element for preventing the heat contraction, as shown in FIG. 13, the heat contraction may occur by the relationship among the physical characteristic of the material employed in the writable film layer 110 and the heat temperature and heat amount.

FIG. 13 is the schematic view showing the heat contraction by the laser marking when there is no heat contraction prevention measure.

As shown in FIG. 13 (*a*), the information writable film 100 of this example is irradiated by the laser beam, and the writable film layer 110 absorbs the energy of the laser beam and colors white. In this process, heat is generated locally. Corresponding to the condition of the combination of the material employed in the writable film layer 110 and the temperature and the amount of the heat, the writable film layer 110 may be damaged by heat contraction or heat deformation.

FIG. 13 (*b*) is the schematic view showing the written identification code patterns when the writable film layer 110 is heat contracted or heat deformed. If the heat contraction or heat deformation has occurred in the writable film layer 110, as shown in FIG. 13 (*b*), the identification code patterns are written in white in the writable film layer 110 by the laser marking, but the written identification code patterns are deformed or blurred by heat contraction or heat deformation. As a result, it is difficult to recognize the written identification code patterns.

Therefore, the second information writable film 100*a*1 of this embodiment 2 employs the heat contraction prevention layer 120*a* on the lower surface of the writable film layer 110 for preventing the heat contraction by the rigidity of the heat contraction prevention layer 120*a*. The writable film layer 110 is not deformed easily due to the presence of the heat contraction prevention layer 120*a* with larger rigidity along the lower surface of the writable film layer 110. The writable film layer 110 is kept planar without deforming. By this configuration, if the heat is generated by the laser marking process in the writable film layer 110, it is not deformed due to the rigidity of the heat contraction prevention layer 120*a*.

According to this second information writable film of the embodiment 2, as shown in FIG. 13 (*b*), the written identification code patterns can be recognized easily because there is no heat contraction or blur on the edge of the white coloring pattern.

The heat contraction prevention layer 120*a* has black color, so the heat generated in the laser marking in the writable film layer 110 may be diffused to the heat contraction prevention layer 120*a* for reducing the heat harmful effect in the writable film layer 110.

In addition, the heat contraction prevention layer 120*a* has black color, so it works as the reading assistance layer 120 described in embodiment 1 for enhancing the contrast ratio in the reading process.

As the material for the heat contraction prevention layer 120*a*, various materials can be employed having chemical and physical stability. The example of the material of the heat contraction prevention layer 120*a* is selected from the group consisting of polypropylene, polyethylene, polyethylene terephthalate, polybutylene terephthalate, polycarbonate, polyamide, polyester, polystyrene, polyolefin type elastomer, polyester type elastomer, polyamide elastomer, polyamide-imide elastomer, polyester elastomer, polysulfone, polyether sulfone, polyphenylene ether, polyphenylene sulfide, liquid crystal polymer, polyvinylidene fluoride, polytetrafluoroethylene, styrene/vinylidene acetate copolymer, polyether ester amide, phenolic resin, epoxy resin, novolak resin, ABS resin and ASA resin. The material for the heat contraction prevention layer 120*a* can be selected one of them or plural of blend combination. It may be polymer alloys consisting of two or more resins.

For example, polypropylene is employed for the material of the heat contraction prevention layer 120*a*. Polypropylene is stable chemically, and has high chemical resistance. It is preferable for mixing black colorant such as black inorganic pigment, black organic pigment and black dye to obtain black color.

Next, the example shown in FIG. 10 (*b*) is described as follows.

The second information writable film 100*a*2 shown in FIG. 10 (*b*) comprises a three layer structure of the writable film layer 110, the reading assistance layer 120 and the transparent protection layer 130 on the upper surface of the writable film layer 110.

The writable film layer 110 and the reading assistance layer 120 are the same as described in embodiment 1, and the description is omitted here. Various combinations are possible as described in embodiment 1.

In this example, the original color of the writable film layer 110 before coloring is translucent light gray, the coloring color of the writable film layer 110 after coloring is white, and the color of the reading assistance layer 120 is black, for example.

The transparent protection layer 130 is a transparent layer installed onto the writable film layer 110 for protecting its surface. The transparent protection layer 130 has larger rigidity than that of the writable film layer 110 and the reading assistance layer 120. The transparent protection layer 130 serves the prevention function for preventing the heat contraction due to its rigidity larger than that of the writable film layer 110 and the reading assistance layer 120.

FIG. 12 is the schematic view of the laser marking writing process of the information writable film 100*a*2 employing this transparent protection layer 130. The transparent protection layer 130 is on the surface, but the laser beam can pass through the transparent protection layer 130 because it is transparent and the laser beam can reach writable film layer 110. The same as embodiment 1, when the information writable film 100*a*2 of this example is irradiated by the laser beam, the portion receiving the laser beam colors white. As a result, the identification code patterns are written in white in the writable film layer 110 by the laser marking.

As shown in FIG. 12, the writable film layer 110 can be kept in plane without deforming because the transparent protection layer 130 that has a large rigidity supports the upper side of the writable film layer 110. There is no heat contraction on the writable film layer 110 because of the presence of the transparent protection layer 130. Therefore, the identification code patterns coloring in white is recognized easily because there is no deformation and no blur in pattern edge.

FIG. 12 (*b*) is the schematic view of the laser marking writing process of the second information writable film 100*a*2 of this embodiment 2. As shown in FIG. 12 (*b*), if the identification code patterns are written in white by the laser marking, the black color of the reading assistance layer 120 is superimposed to the white colored identification code patterns through the writable film layer 110 and the transparent protection layer 130. As a result, the contrast ratio between the black background and white code pattern become large.

Furthermore, the transparent protection layer 130 serves to protect from harmful outside influences such as chemical agents and abrasion.

As the material for the transparent protection layer, various materials can be employed as long as they have chemical and physical stability. The example of the material of the transparent protection layer 130 is selected from the group consisting of polypropylene, polyethylene, polyethylene terephthalate, polybutylene terephthalate, polycarbonate, polyamide, polyester, polystyrene, polyolefin type elastomer, polyester type elastomer, polyamide elastomer, polyamide-imide elastomer, polyester elastomer, polysulfone, polyether sulfone, polyphenylene ether, polyphenylene sulfide, liquid crystal polymer, polyvinylidene fluoride, polytetrafluoroethylene, styrene/vinylidene acetate copolymer, polyether ester amide, phenolic resin, epoxy resin, novolak resin, ABS resin and ASA resin. The material for the transparent protection layer 130 can be selected one of them or plural of blend combination. It may be polymer alloys consist of two or more resins.

For example, polypropylene is employed for the material of the transparent protection layer 130. Polypropylene is chemically stable, and has high chemical resistance.

In the above-mentioned example, the coloring color of the writable film 110 is white and the color of the reading assistance layer 120 is black. However, the color relationship between black and white can be reversed. Furthermore, the combination of achromatic or chromatic can be employed as described in embodiment 1.

Embodiment 3

In this embodiment 3, the sample storage 200 of the present invention installing the information writable film 100 shown in embodiment 1 or the information writable film 100*a*1 or 100*a*2 shown in embodiment 2 is described as follows.

FIG. 14 (*a*) is a container 210 of a sample storage body 200. The size and shape are not limited. Various types can be employed as the container 210 of the sample storage body 200.

The two layer structure of the information writable film 100 shown in embodiment 1 or three layer structure of the information writable film 100*a* shown in embodiment 2 is adhered onto the container 210 of the sample storage body 200 as shown in FIG. 14 (*b*).

The heat contraction prevention layer 120*a* or the transparent protection layer 130 that has large rigidity is employed for the heat contraction prevention. However, these layers have flexibility for curving along to the curve surface of the container 210 of the sample storage body despite the rigidity.

As shown in FIG. 14 (*c*), the information writable film 100 of this example is irradiated by the laser beam, the identification code patterns are written in white in the writable film layer 110 by the laser marking. As a result, recognizable identification code patterns are written in each sample storage body 200 respectively as shown in FIG. 14 (*d*). The written identification code patterns have a large contrast ratio and these are recognized easily.

It is possible to install the information writable film onto a bottom surface or side wall. The drawings are omitted here.

In the above-mentioned example, the coloring color of the writable film 110 is white and the color of the reading assistance layer 120 is black. However, the color relationship between black and white can be reversed. Furthermore, the combination of achromatic or chromatic can be employed as described in embodiment 1.

Embodiment 4

The embodiment 4 shows the sample storage 200*b* of the present invention installing the information writable film shown in embodiment 2 as a shrink wrap film, in which the transparent protection layer is made of film for the shrink wrap film.

As shown in FIG. 15 (*a*), the information writable film 100*b* of the embodiment 4 comprises the writable film layer 110, the reading assistance layer 120 and the transparent protection layer 130*b*, which can serve as the shrink wrap film. In other words, the writable film layer 110 and the reading assistance layer 120 are installed on the shrink wrap film 130*b*.

The information writable film 100*b* is wrapped around the sample storage body by the shrink wrap method in advance of the writing process to the sample storage body as shown in FIG. 15 (*b*). In the writing process, the identification can be written in the writable film layer 110 by the laser beam irradiation to the writing area of the sample storage body 200*b* as shown in FIG. 15 (*c*).

In the above-mentioned example, the coloring color of the writable film 110 is white and the color of the reading assistance layer 120 is black. However, the color relationship between black and white can be reversed. Furthermore, the combination of achromatic or chromatic can be employed as described in embodiment 1.

Embodiment 5

The embodiment 5 shows the example of the information writable film in which the transparent protection layer 130*c* has the handwriting area 140 made of the material that can accept an ink composition for writing utensil or a paint composition for writing utensil.

FIG. 16 (*a*) is the schematic view of embodiment 5 of the information writable film 100*c* and the sample storage body 200*c* on which the information writable film 100*c* is adhered.

As shown in FIG. 16 (*a*), the handwriting area 140*c* for accepting the handwriting is installed onto the information writable film 100*c*. The handwriting area 140*c* is made of the material that can accept an ink composition for writing utensil or a paint composition for writing utensil. Therefore, the sample storage body 200*c* can accept the information such as characters, numerals, signals and marks by handwriting easily.

FIG. 16 (*b*) is the schematic view showing the characteristic of the sample storage body that the identification code pattern are written by laser marking followed by the check mark handwriting on the handwriting area 140*c* by the user.

Due to the handwriting area 140*c*, the user can write simple information for sample storage control to the sample storage body 200*c* directly during the managing procedure by the user.

Embodiment 6

The information writable film of embodiment 6 includes transparent protection layer 130*d* that covers the whole area in which the writable film layer and the reading assistance layer are formed on a part of area serving as an information writable area. The other area of the information writable area serves as a transparent window area composed only of the transparent protection layer 130*d*, through which an observer can observe inside of the target object.

FIG. 17(*a*) is the schematic view of embodiment 6 of the information writable film 100*d* and the sample storage body 200*d* on which the information writable film 100*d* is adhered.

As shown in FIG. 17 (*a*), the writing area 150 is installed onto a part of the information writable film 100*d*. The writing area 150 includes the writable film layer and the reading assistance layer, so the identification code pattern can be written. However, the other area includes only the transparent protection layer 130*d*.

FIG. 17 (*b*) is the schematic view of the laser marking writing process for writing the identification code patterns to the writing area 150*d* by the laser marking.

Due to the writing area 150 and the other transparent area, the identification code patterns can be written in the writing area 150 by laser marking and the user can observe the inside of the sample storage body through the transparent area.

Embodiment 7

The embodiment 7 describes the example of the identification code patterns by reversing the patterns and background relationship.

Through embodiment 1 to embodiment 6, the identification code patterns are written by coloring the identification code patterns as white by the laser marking onto the black background media. For example, as shown in FIG. 18 (*a*), the identification code patterns (for example, barcode or two dimension dot code) are written by coloring the bars or dots itself as white. The identification code patterns can be obtained by black and white contrast, so there is another way. If the background color of the writable film layer 110 is black, the portions except for code patterns are colored white. As a result, the white coloring portion can work as the white background for the portions left black that work as the identification code patterns (for example the portion left black can be seen as black barcode or two dimension dot code) as shown in FIG. 18 (*b*). In FIG. 18 (*b*), the black identification code patterns are not written by laser marking coloring but left as the original color of the background of the writable film layer 110. The portion between barcode patterns and outer portion of the barcode (the outside of the identification code edge) is colored white. As a result, the non-colored portions which do not color white are left black and the identification code patterns expressed in black.

The laser marking of the identification code patterns by reversing the code patterns and background relationship, and the portion for irradiating laser beam are shown in white in FIG. 18 (*b*). The coloring color is white but the obtained identification code patterns are expressed in black.

In the above-mentioned example, the coloring color of the writable film 110 is white and the color of the reading assistance layer 120 is black. However, it is possible to reverse the relationship as the coloring color of the writable film 110 is black and the color of the reading assistance layer 120 is white.

While some preferable embodiments of the information writable film and the sample storage body according to the present invention are described above, it should be understood that various changes are possible, without deviating from the technical scope according to the present invention.

INDUSTRIAL APPLICABILITY

The information writable body according to the present invention can be used extensively as the writable media to be applied for sample storage bodies for storing a large number of samples. The information writable film does not limit the target object to be applied, and it can apply to various products such as electricity product, home electric apparatus, display apparatus, electronics product and industrial product.

BRIEF DESCRIPTION OF THE DRAWINGS

FIG. 1 is a schematic view of the configuration of the information writable film 100 in the first example of embodiment 1.

FIG. 2 is a schematic view of the laser marking writing process for writing the identification code patterns to the information writable film 100 of the first example.

FIG. 3 is a cross-sectional view of the information writable film 100 after laser marking.

FIG. 4 is a schematic view of the configuration of the information writable film 100 in the second example of embodiment 1.

FIG. 5 is a schematic view of the laser marking writing process for writing the identification code patterns to the information writable film 100 of the second example.

FIG. 6 is a schematic view of the configuration of the information writable film 100 in which the color of the writable film layer is transparent, the coloring color is black and the color of the reading assistance layer is white of this example 3.

FIG. 7 is a schematic view of the laser marking writing process for writing the identification code patterns to the information writable film 100 of the third example.

FIG. 8 is a schematic view of the information writable film 100 of example 5 comprises only the writable film layer 110 and the state of adhering it onto the black surface of the target object.

FIG. 9 is a schematic view of the information writable film 100 of example 6 comprises only the writable film layer 110 and the state of adhering it onto the black surface of the target object.

FIG. 10 is a schematic view of the configuration of the information writable film 100*a* of embodiment 2.

FIG. 11 is a cross-sectional view of the information writable film 100*a* with the heat contraction prevention layer 120*a* after laser marking.

FIG. 12 is a cross-sectional view of the information writable film 100*a* with the transparent protection layer 130 after laser marking.

FIG. 13 is a schematic view of the case that the heat contraction has occurred by laser marking due to no transparent protection layer 130.

FIG. 16 is a schematic view of the information writable film 100*c* in which the handwritten area 140 is installed onto the transparent protection layer 130*c* and the sample storage body 200*c*.

FIG. 17 is a schematic view of the information writable film 100*d* in which the written area 150 is installed onto the transparent protection layer 130*d* and the sample storage body 200*d*.

FIG. 18 is a schematic view of the example of the identification code pattern composition by reversing the patterns and background relationship.

EXPLANATION OF SYMBOLS

Figure 14:
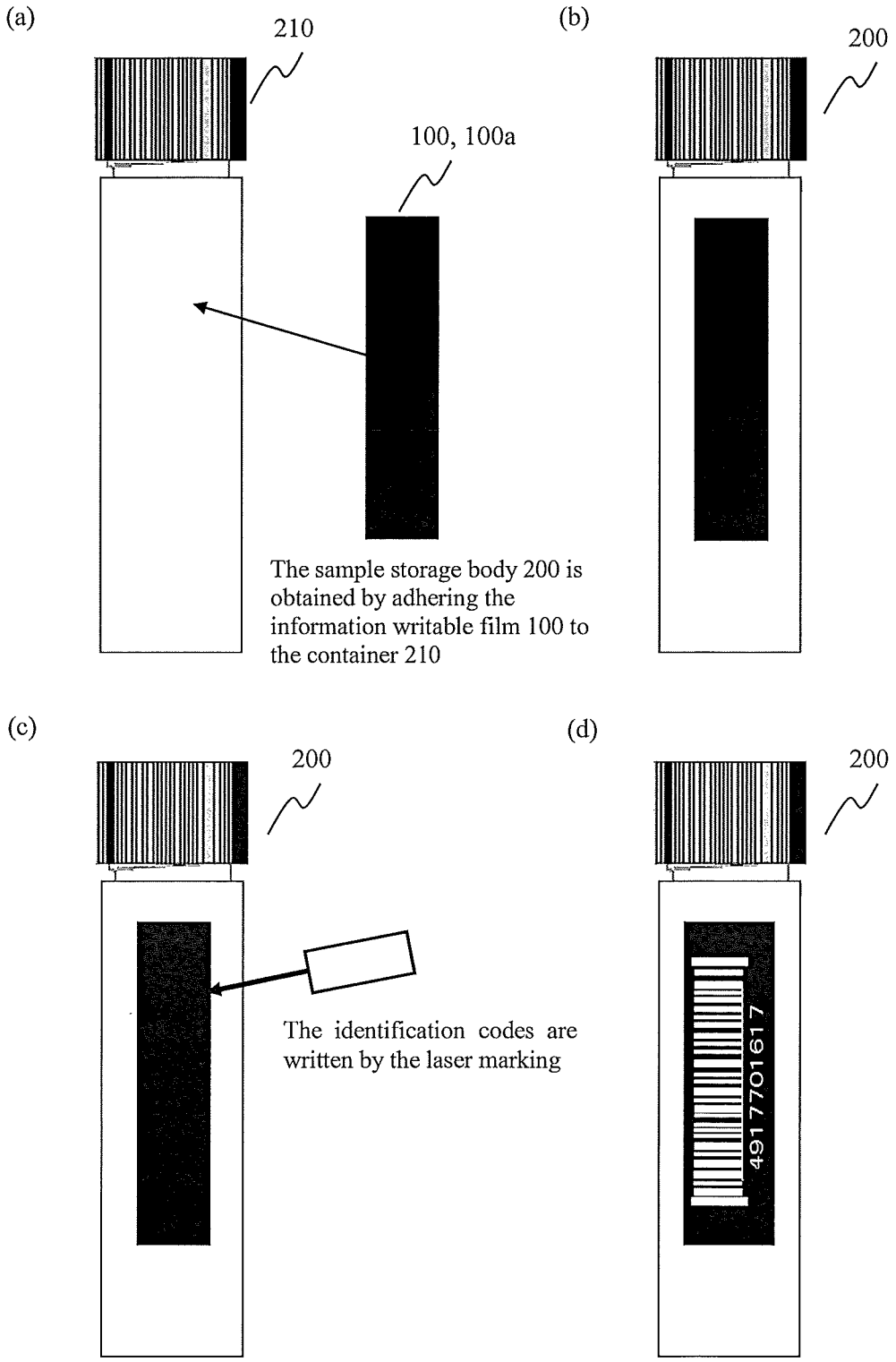
FIG. 14 is a schematic view of the sample storage body 200 installing the information writable film around the body.
Figure 15:
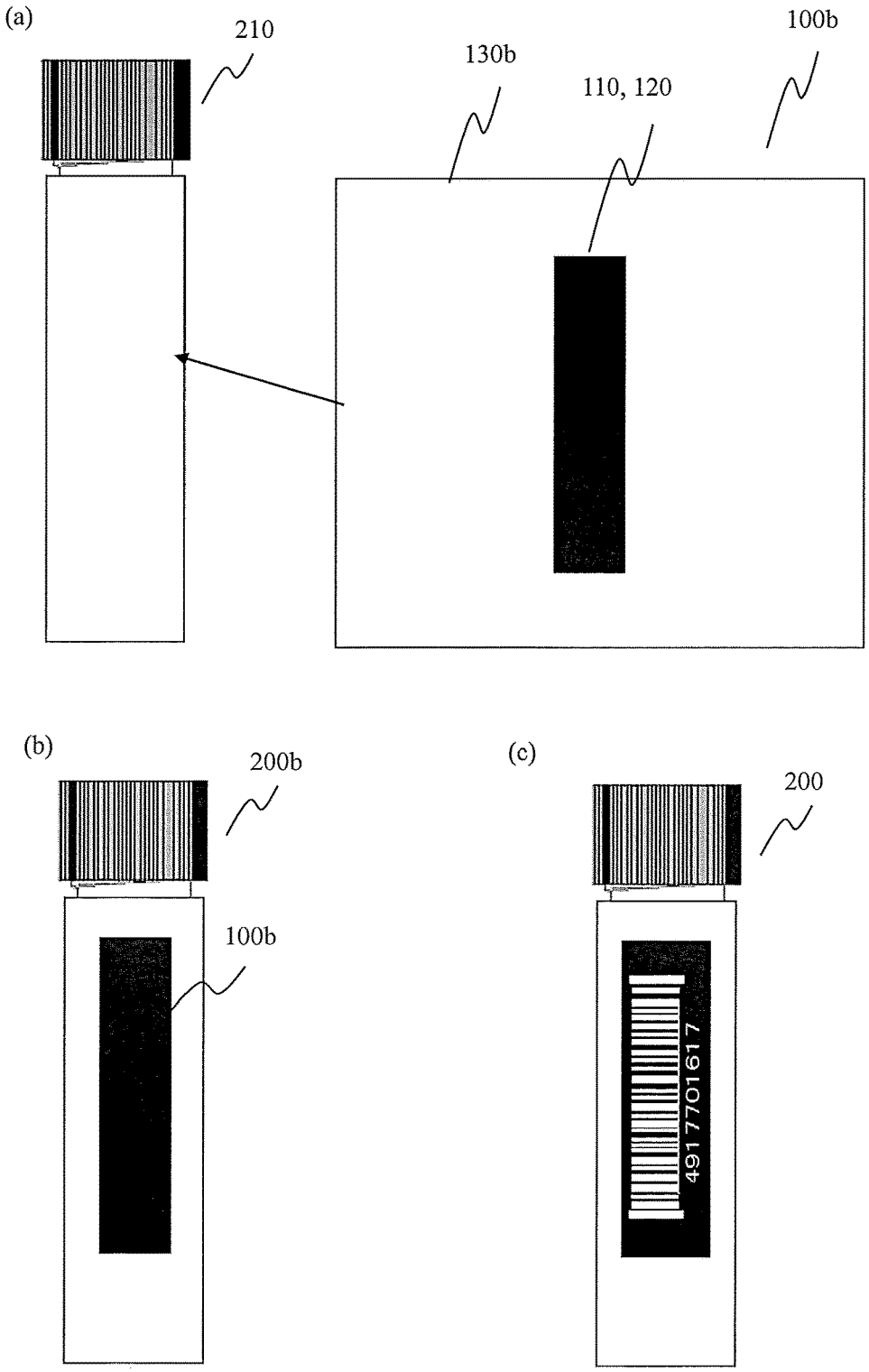
FIG. 15 is a schematic view of the information writable film 100*b* including the transparent protection layer 130*b* working as the shrink wrap film and the sample storage body 200*b*.

100, 100*a*, 100*b*, 100*c* information writable film
110 writable film layer
120 reading assistance layer
130 transparent protection layer
140 handwriting area
150 writing area
200 sample storage body
210 container

The invention claimed is:

1. An information writable film applicable to the surface of a target, the color of the area of the target where the information to be written by a laser marking is not limited and a mark written in the information writable film in white, comprising;

a writable film layer made of light-transmissive material formed in a film shape, wherein a color former including a photo-sensitive composition or a heat-sensitive composition, which can be changeable from a black color with light transmission ratio at 0% to 95% to a white color state by shifting a physical characteristic or a chemical characteristic by irradiating a particular wavelength laser beam, is mixed with a transparent plastic resin having a desired chemical resistance and structural strength;

a reading assistance layer under the writable film layer, whose color is darker black having lower light transmission ratio than that of the writable film layer, and having adhesiveness to the surface of the target;

the writable film layer with the reading assistance layer as two layers having enhanced chemical resistance and structural strength by mixing with the transparent plastic resin, and the deterioration of the contrast ratio due to mixing with the transparent plastic resin is avoided by superimposing the black color of the reading assistance layer, wherein an anti-heat contraction black layer having black color or dark color and having higher rigidity than that of the writable film layer is applied under the writable film layer as the reading assistance layer, which serves both as the component for absorbing heat generated in the writing process of the identification code by the laser beam to the writable film layer and as the component for prevention of heat contraction due to its rigidity and as the component for enhancing the contrast ratio by its black or dark color.

2. An information writable film as claimed in claim 1, further comprising:

a transparent protection layer having higher rigidity than that of the writable film layer and the reading assistance layer applied above the writable film layer;

the transparent protection layer prevents the writable film layer from deforming by the heat generated by the laser beam to the writable film layer in the identification code writing process.

3. An information writable film as claimed in claim 2, in which the transparent protection layer is made of a shrink-wrap sheet material, the information writable film being applied around the surface of the target object by the shrink-wrap sheeting process in advance for the information writing process, in the information writing process, the area of the target where the information to be written by a laser marking has been provided with the information writable film by the shrink-wrap sheeting and the identification code information can be written by laser beam through the transparent protection layer.

4. An information writable film as claimed in claim 2, in which a handwriting area is present at a partial area of the transparent protection layer, which is made of a material that can accept an ink composition for writing utensil or a paint composition for writing utensil.

5. An information writable film as claimed in claim 1, wherein the writable film layer and the reading assistance layer are formed on a part area of the whole area that serves as an information writable area, the other area of the whole area serves as a transparent window area composed only of the transparent protection layer and through which an observer can observe inside of the target object.

6. An information writable film as claimed in claim 1, in which the identification code is written by white coloring a portion except for a portion of an identification code pattern, and as a result, the identification code emerges as the pattern of a remaining portion that does not color white.

7. An information writable film as claimed in claim 1, in which the material of the transparent plastic resin of the writable film layer is selected from the group consisting of polypropylene, polyethylene, polyethylene terephthalate, polybutylene terephthalate, polycarbonate, polyamide, polyester, polystyrene, polyolefin type elastomer, polyester type elastomer, polyamide elastomer, polyamide-imide elastomer, polyester elastomer, polysulfone, polyether sulfone, polyphenylene ether, polyphenylene sulfide, liquid crystal polymer, polyvinylidene fluoride, polytetrafluoroethylene, styrene/vinylidene acetate copolymer, polyether ester amide, phenolic resin, epoxy resin, novolak resin, ABS resin and ASA resin.

8. A sample storage body comprising;

a container for containing a sample; and an information writable film as claimed in claim 1.

9. A sample storage body as claimed in claim 8, in which the information writable films are installed to both a bottom portion and an upper lid portion in addition to a sidewall.

10. An industrial product comprising an information writable film as claimed in claim 1 attached to a portion of a housing.

* * * * *